United States Patent [19]

Noguchi et al.

[11] 4,030,931

[45] June 21, 1977

[54] HEAT DEVELOPABLE LIGHT-SENSITIVE MATERIAL

[75] Inventors: Yasuhiro Noguchi; Toshinao Ukai; Kenji Sashihara; Takao Masuda, all of Asaka, Japan

[73] Assignee: Fuji Photo Film Co., Ltd., Minami-ashigara, Japan

[22] Filed: May 19, 1975

[21] Appl. No.: 578,833

[30] Foreign Application Priority Data

May 17, 1974 Japan ..... 49-55114

[52] U.S. Cl. ..... 96/114.1; 96/68; 96/76 R; 96/114.6

[51] Int. Cl.[2] ..... G03C 1/02

[58] Field of Search ..... 96/114.1, 114.6, 90 R, 96/66 HD, 68, 76 R, 85, 87 R; 260/473 S

[56] References Cited

UNITED STATES PATENTS

| | | | |
|---|---|---|---|
| 3,330,859 | 7/1967 | Dexter et al. | 260/473 |
| 3,661,583 | 5/1972 | Van Der Voorn | 96/114.1 |
| 3,816,132 | 6/1974 | Takegawa et al. | 96/114.1 |
| 3,827,889 | 8/1974 | Ohkubo et al. | 96/114.1 |
| 3,885,967 | 5/1975 | Sashihara et al. | 96/114.1 X |
| 3,885,968 | 5/1975 | Ikenoue et al. | 96/114.1 |

FOREIGN PATENTS OR APPLICATIONS

| | | |
|---|---|---|
| 1,337,163 | 7/1963 | France |
| 6,506,933 | 12/1965 | Netherlands |

OTHER PUBLICATIONS

J. M. Farber, "Adhesive Age", Aug. 1968, pp. 24–28, Publ. Geigy Industrial Chemicals, Ardsley, N.Y.

*Primary Examiner*—Thomas J. Herbert, Jr.
*Attorney, Agent, or Firm*—Sughrue, Rothwell, Mion, Zinn & Macpeak

[57] ABSTRACT

A heat developable light-sensitive material comprising a support having thereon or therein at least (a) an organic silver salt, (b) a light-sensitive silver halide or a light-sensitive silver halide-forming component and (c) as a reducing agent at least one ester selected from the group consisting of (1) esters of carboxylic acids derived from phenol derivatives in which at least one of the o-positions thereof is substituted, preferably substituted with a bulky group, and mono- or poly-hydric alcohols, and (2) esters of alcohols derived from polyhydric phenols in which at least one of the o-positions thereof is substituted, preferably substituted with a bulky group, and mono- or polycarboxylic acids, to reduce the thermal fog produced at the background after heat development processing, and to increase the whiteness of the unexposed areas and the stability to normal room illumination.

21 Claims, No Drawings

HEAT DEVELOPABLE LIGHT-SENSITIVE MATERIAL

BACKGROUND OF THE INVENTION

1. Field of the Invention

This invention relates to heat developable light-sensitive materials and particularly to heat developable light-sensitive materials which contain certain kinds of esters as a reducing agent, and which have reduced thermal fog at the background, increased whiteness and high stability to normal room illumination due to presence of these esters.

2. Description of the Prior Art

Photography using silver halide has been much more universally carried out till now, as compared with electrophotography, diazo photography and the like, because the former has superior photographic characteristics such as sensitivity, gradation, etc., than the latter. However, silver halide photography requires much time and labor, since silver halide light-sensitive materials employed therein must be subjected to several processings using solutions comprising an image-exposure process; a developing process with a developer; and processes for preventing the developed-image from changing color or deteriorating under indoor illumination or protecting the non-developed white areas (hereinafter called "background") from blackening; that is, a stopping, a fixation, a washing and rinsing, a stabilizing and other similar processes. In addition, chemical agents used in this method are dangerous to the human body, and the processing room and the workers' hands and clothes are often stained by these agents. Moreover, pollution difficulties arise by discharging processing solutions into rivers. Therefore, it has been strongly desired to improve silver halide-containing light-sensitive materials with high sensitivity so as to deal with them in a dry condition instead of processing with solutions, so as to maintain the developed-images stable, and so as to reduce the color change of the background under indoor illumination.

In order to solve these problems, many efforts have been made. For example, the addition of 3-pyrazolidone system as a developing agent into a silver halide emulsion has made it possible to develop by application of heat as disclosed in German Pat. application OLS Nos. 1,123,203; 1,174,157 and so on. In addition, the coexistence of water-generating substances with the above-mentioned developing agent in the course of heating can promote the developing reaction as disclosed in German Pat. application OLS No. 1,175,075. Moreover, the effect of a fixing agent for silver halide when added together with water-generating substances to the above-mentioned developing agent is described in German Pat. application OLS No. 1,003,578. However, the above techniques do not make it possible to completely stabilize the silver halide itself, which remains in the finished light-sensitive material processed under dry conditions, to light. Namely, fixation under dry conditions is not described in the above three patent specifications, and as would be expected, the coexistence of a developing agent (reducing agent) with a fixing agent, which is described in German Pat. application OLS No. 1,175,075, will cause undesirable reactions on storage, and they will, therefore, render this technique industrially impractical. These have been experimentally confirmed.

In the art of light-sensitive materials which provide photographic images using photographic treatments under dry conditions, the most successful materials have been heat developable light-sensitive materials which were disclosed in U.S. Pat. Nos. 3,152,904 and 3,457,075; and wherein the composition containing as essential components a silver salt of an organic acid, a small amount of a silver halide and a reducing agent was employed. In the above light-sensitive system, silver halides remaining in the light-sensitive materials after developing processing were allowed to remain even though they changed color, without stabilizing them to light. Nevertheless, the above light-sensitive system as well as those light-sensitive materials containing residual silver halide which received a stabilization treatment for light produced satisfactory results. This was because only a small amount of silver halide was used therein, a large portion of the silver component was present in the form of white or pale yellow organic silver salts which were so stable to light that they hardly blackened on exposure, and a slight coloration resulting from the decomposition of a small amount of residual siler halide by application of light is hardly perceived by the human eye. The above light-sensitive system is stable at ordinary temperature, but when heated up to about 80° C, and preferably 100° C, after image-exposure, an image is formed because an organic silver salt as an oxidizing agent and a reducing agent incorporated in a light-sensitive layer undergo a redox reaction in the presence of a catalytic amount of exposed-silver halide present in the vicinity thereof, to result in the liberation of silver which blackens quickly the exposed area of the light-sensitive layer and causes a contrast to the unexposed area thereof (background).

The present invention relates to an improvement in the above-described heat developable light-sensitive materials, particularly the reducing agents incorporated therein, which is carried out with the intention of producing satisfactory results as described hereinafter. In order to use reducing agents as an effective constituent of heat developable light-sensitive materials, they must be able to reduce organic silver salts when heated in presence of the catalyst of the exposed silver halide, that is, to have a heat developable property. Reducing agents which have already been proposed in the patent art and the like include substituted phenols, substituted or unsubstituted bisphenols, substituted or unsubstituted mono- or bis naphthols, di- or poly-hydroxybenzenes, di- or poly-hydroxynaphthalenes, hydroquinone monoethers, ascorbic acid or the derivatives thereof, 3-pyrazolidones, pyrazoline-5-ones, reducing saccharides, p-phenylendiamine or the derivatives thereof, reductones, kojic acid, hinokitiol, hydroxylamines, hydrooxaminic acids, sulfohydrooxaminic acids, hydrazides, indane-1,3-diones, p-oxyphenylglycine and so on. A number of patents are concerned with these reducing agents, as disclosed, for example, in U.S. Pat. Nos. 3,152,904; 3,457,075; 3,531,286; 3,615,533; 3,679,426; 3,672,904; 3,751,252; 3,751,255; 3,782,949; 3,770,448 and 3,773,512; German Pat. application OLS No. 2,031,748 and Belgian Pat. No. 786,086.

However, these reducing agents undesirably blacken the unexposed area during the heat developing process, namely they produce much thermal fog. Even if heat-developed for a comparatively short time, the light-sensitive materials containing such reducing agents also have a light yellow-brown stain at the background.

Moreover, the background of these processed light-sensitive materials becomes yellow-brown due to scattered light in a room.

The solution to the above-described problems has been an important subject in the art of heat developable light-sensitive materials.

SUMMARY OF THE INVENTION

It is, therefore, an object of the present invention to provide a heat developable light-sensitive material, the background of which has a remarkably reduced thermal fog.

Another object of the present invention is to provide a heat developable light-sensitive material which has increased whiteness and an excellent appearance.

A further object of the present invention is to provide a heat developable light-sensitive material which exceedingly stable to scattered light after being development-processed.

These and other objects of the present invention will become apparent from the following descriptions.

The above-described objects of the present invention are attained by employing the following constituent elements. Namely, the heat developable light-sensitive material of the present invention comprises a support having therein or thereon at least (a) an organic silver salt, (b) a light-sensitive silver halide or a light-sensitive silver halide-forming component and (c) at least one ester as a reducing agent which is selected from the group consisting of two classes of esters, i.e., (1) esters of carboxylic acids derived from phenol derivatives in which at least one of the o-positions thereof is substituted, preferably substituted with a bulky group, and mono- or poly-hydric alcohols, and (2) esters of alcohols derived from polyhydric phenols in which at least one of the o-positions thereof is substituted, preferably substituted with a bulky group, and mono- or polycarboxylic acids.

DETAILED DESCRIPTION OF THE INVENTION

An important characteristic component of the present invention is component (c) which comprises of two classes the esters as described above. The former class (1) includes esters of carboxylic acids derived from phenols in which at least one of the o-positions thereof is substituted, preferably substituted with a bulky group, and mono- or poly-hydric alcohols or phenols. As used herein the term "bulky group" includes (1) a branched-chain alkyl group having 3 or more carbon atoms, (2) a straight-chain alkyl group having 12 or more carbon atoms, and (3) a cycloalkyl group having 5 to 7 carbon atoms, and a bulky group is preferred as the o-susbtituent.

Preferred reducing agents belonging to such esters (1) have the following general formula (I):

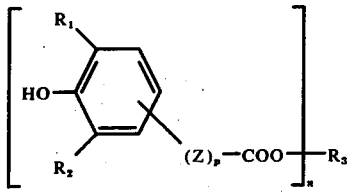

(I)

wherein $R_1$ represents an alkyl group having 1 to 20 carbon atoms such as a methyl group, an ethyl group, a propyl group, an isopropyl group, a butyl group, an isobutyl group, a tertiary butyl group, an isoamyl group, a hexyl group, an octyl group, a 2-ethylhexyl group, a decyl group, a dodecyl group, a tetradecyl group, a hexadecyl group, an octadecyl group, etc., more preferably a tertiary butyl group, a dodecyl group, a hexadecyl group and an octadecyl group or an alkylsulfonyl group having 1 to 20 carbon atoms such as a methylsulfonyl group, an ethylsulfonyl group, a propylsulfonyl group, a butylsulfonyl group, a pentylsulfonyl group, an isopropylsulfonyl group, a t-butylsulfonyl group, a neopentylsulfonyl group, an octylsulfonyl group, a nonylsulfonyl group, a dodecylsulfonyl group, and an eicosylsulfonyl group; $R_2$ represents a hydrogen atom, an alkyl group or an alkylsulfonyl group as described for $R_1$, which can be the same as or different from $R_1$; Z represents a divalent atom such as a thio (—S—) group, an oxy (—O—) group, etc., or a divalent group containing up to 30 carbon atoms such as an alkylene group of the formula $—(CH_2)_l—$ where l is an integer of 1 to 10, e.g., (a methylene or polymethylene group) such as $—CH_2—$, $—CH_2CH_2—$, $—CH_2CH_2CH_2—$, etc.), an alkylidene group, a substituted methylene or polymethylene group, etc.; $R_3$ represents a mono- or multivalent alcohol or phenol residue, e.g., a monovalent residue of an alcohol or phenol without an —OH group and including residues such as an alkyl group, an alkythioalkyl group, a cycloalkyl group, an alkoxycarbonylalkyl group, an (alkoxycarbonylalkyl)thioalkyl group, an aryl group, an aralkyl group, an alkyl-substituted aryl group, or a heterocyclic-residue-substituted alkyl group; p represents 0 or 1; and n represents a positive integer equal to the valence of the above $R_3$.

A wide variety of mono- or poly-hydric alcohols or phenols can be used as the component forming the above esters of carboxylic acids. They include derivatives of not onluy aliphatic and aromatic hydrocarbons but also compounds comprising hydrogen atoms, carbon atoms, nitrogen atoms, oxygen atoms, sulfur atoms and so on, in which one or more hydrogen atoms can be replaced by corresponding hydroxyl groups. As to the alcohols, unsaturated alcohols, as well as saturated alcohols, can also be employed as the effective ester component. In addition, the esters of polyhydric alcohols and phenols can include free hydroxyl group-containing esters where all of the hydroxyl groups are not esterified.

Specific examples of suitable alcohol residues include a methyl group, an ethyl group, a butyl group, a hexyl group, a dodexyl group, an octadecyl group, a t-butyl group, an isopropyl group, a neopentyl group, a benzyl group, a cyclopentyl group, a cyclohexyl group, a 3-thiaheneicosyl group, a 3-thiaundecyl group, a 9,9-dimethyldecyl group, a 4-thiaheneicosyl group, a 5-thiaheneicosyl group, a 6-oxo-7-oxa-3-thianonadecyl group, a 2-phtalimidoethyl group, a 3,6-dithiaoctadecyl group, a 7-oxo-8-oxa-4-thiadodecyl group, a β-(3,5-di-t-butyl-4-hydroxyphenethylcarbonyloxy) ethyl group, etc., and of suitable phenol residues include a 4-octylphenyl group, a 2,4-di-t-butylphenyl group, a 2,5-di-t-butyl-4-hydroxyphenyl group, etc.

Particularly preferred esters belonging to the above class (1) include the esters of 3,5-di-tert-butyl-4-hydroxyphenyl group-containing carboxylic acids, and mono- or poly-hydric alcohols or phenols, which are represented by the following formula:

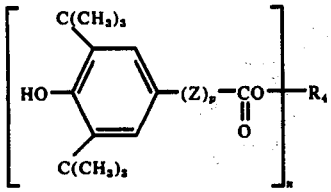

wherein $R_4$ represents a mono- or multi-valent alcohol or phenol residue, e.g., as defined hereinbefore for $R_3$; n represents a positive integer equal to the valence of the above alcohol or phenol residue of $R_4$; p represents 0 or 1; and Z represents a divalent group, as defined hereinbefore.

In the above general formula, the esters corresponding to the case where p is 0 (i.e., Z is absent) or where Z is an alkylene group, i.e., $Z=-(CH_2)_l-$, wherein l represents an integer ranging from 1 to 10, and where $R_4$ represents a monovalent alcohol residue to result in n=1, can be synthesized extremely easily, and they have excellent heat developing properties.

Specific examples of esters which are particularly preferred in the present invention are as follows, wherein R represents a 3,5-di-tert-butyl-4-hydroxyphenyl group, and the alkyl groups are (n)-alkyl groups unless otherwise indicated:

$RCOOCH_3$ 1.

$RCOOC_6H_{13}$ 2.

$RCOOC_{12}H_{25}$ 3.

$RCOOC_{18}H_{37}$ 4.

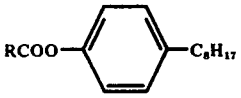

5.

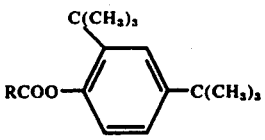

6.

$RCOOC(CH_3)_3$ 7.

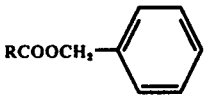

8.

$RCOOCH_2CH_2SCH_2CH_2OH$ 9.

$RCOOCH_2CH_2SC_6H_{17}$ 10.

$RCOOCH_2CH_2SC_{18}H_{37}$ 11.

$RCH_2COOCH_3$ 12.

$RCH_2COOC_{18}H_{37}$ 13.

$RCH_2COOCH_2CH_2SC_{18}H_{37}$ 14.

$RCH_2CH_2COOCH_3$ 15.

$RCH_2CH_2COOC_{12}H_{25}$ 16.

$RCH_2CH_2COO-(CH_2)_8-C(CH_3)_3$ 17.

$RCH_2CH_2COOC_{18}H_{37}$ 18.

-continued $RCH_2CH_2COOR$ 19.

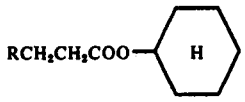

20.

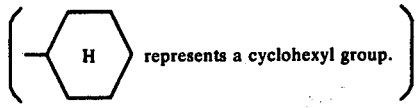

represents a cyclohexyl group.

$RCH_2CH_2COOCH_2CH_2SC_{12}H_{25}$ 21.

$RCH_2CH_2COOCH_2CH_2CH_2SC_{18}H_{37}$ 22.

$RCH_2CH_2COOCH_2CH_2SCH_2CH_2SC_{18}H_{37}$ 23.

$RCH_2CH_2COOCH_2CH_2SCH_2CH_2COOC_{12}H_{25}$ 24.

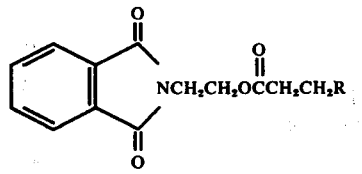

25.

Compounds in which Z in the above general formula is an alkylidene or a substituted alkylidene group and containing a monovalent alcohol residue as $R_4$ can also be effectively used as reducing agents in the present invention. Specific examples of these compounds are illustrated below.

$R-CH(CH_3)COOC_2H_5$ 26.

$R-CH(CH_3)OOC_{18}H_{37}$ 27.

$CH_3OC(=O)-CH(SC_{18}H_{37})-CH(R)COOCH_3$ 28.

$C(R)_3-[CO_2(CH_2)_3S(CH_2)_2COOC_4H_9]_2$ 29.

$C_2H_5OC(=O)-CH_2CH(R)COOC_2H_5$ 30.

$RCH_2CH[COO(CH_2)_3S(CH_2)_2COOC_4H_9]_2$ 31.

$R-CH_2CH_2C(CH_3)-[SCH_2CH_2COOC_{12}H_{25}]_2$ 32.

$RC(CH_3)_2COOC_2H_5$ 33.

$RC(CH_3)_2COOC_8H_{17}$ 34.

The esters of polyhydric alcohols or phenols have been found to function much more effectively as a reducing agent. Specific examples of these esters include the following compounds wherein the following abbreviations are used to simplify the representation; $X=RCH_2CH_2COO-$ and $A=RCH_2COO-$:

$X(CH_2)_qX$ (q = 1,2,3,4,6, or 9) 35.

$XCH_2CH_2OCH_2CH_2X$ 36.

-continued
37. $XCH_2C(CH_3)_2CH_2X$
38. $XCH(CH_3)CH_2X$
39. 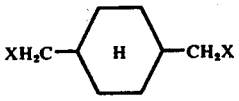
40. $C_{17}H_{35}COOCH_2-CH(CH_2OCOCH_2R)(OCOCH_2R)$
41. $[XCH_2]_3CCH_3$
42. $[XCH_2]_3CC_2H_5$
43. $XCH_2CH(X)CH(X)CH(X)CH(X)CH_2X$
44. 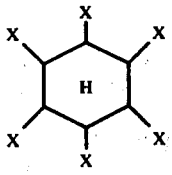
45. $XCH_2CH(X)CH(X)CH_3$
46. $XCH_2CH(X)CH_2X$
47. 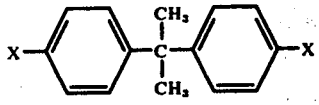
48. 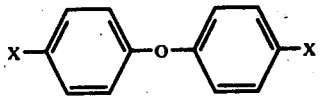
49. 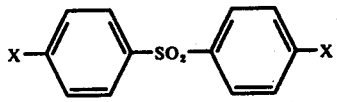
50. 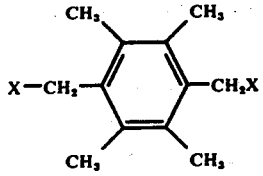
51. 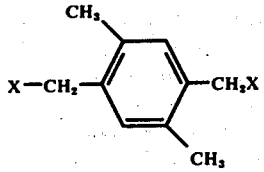
52. 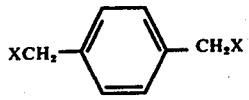
53. 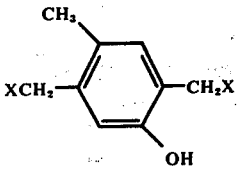
54. 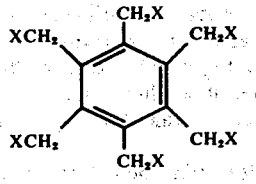
55. 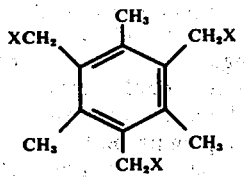
56. 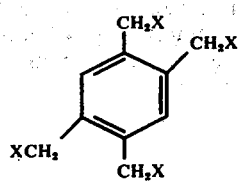
57. $(ACH_2CH_2)_2S$
58. $XCH_2C(CH_2SC_{16}H_{33})_3$
59. 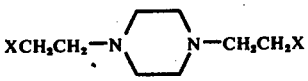
60. $C_{17}H_{35}C(=O)N(CH_2CH_2X)_2$
61. $C_4H_9N(CH_2CH_2X)_2$
62. $(XCH_2CH_2)_3N$
63. $N\left(CH_2CH_2OC(=O)CH_2CH_2CH_2R\right)_3$
64. $N(CH_2CH_2A)_3$
65. $(RCH_2CH_2)_2N-CH_2CH_2-N(CH_2CH_2R)_2$
66. 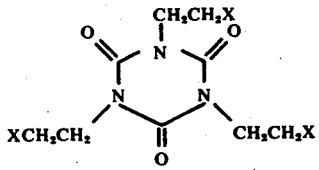
67. 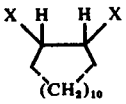

-continued

68.

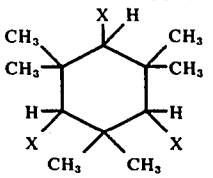

69.

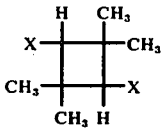

In the present invention, especially advantageous results can be obtained by using esters of pentaerythritol, their dimers or trimers. Specific examples of these esters include:

70. $C(CH_2X)_4$

71. $(XCH_2)_3CCH_2OH$

72. $(XCH_2)_3CCH_2OCH_2C(CH_2X)_3$

73. $(XCH_2)_3CCH_2OCH_2-\underset{\underset{(CH_2X)_2}{|}}{C}-CH_2OC(CH_2X)_3$ wherein the abbreviations X and A used are as previously indicated in the examples given hereinbefore.

Other specific examples of effective esters, which contain unsaturated bonds, include:

74. $CH_2=\underset{\underset{CH_3}{|}}{C}COOCH_2CH_2OCOR$

75. $CH_2=\underset{\underset{CH_3}{|}}{C}H-COOCH_2CH_2A$

76. $CH_2=\underset{\underset{CH_3}{|}}{C}COOCH_2CH_2X$

77. $CH_2=CHCOOCH_2CH_2X$

78. $CH_2=CHCOOCH_2\underset{\underset{CH_3}{|}}{C}HX$

79. $CH_2=\underset{\underset{CH_3}{|}}{C}H-COOCH_2\underset{\underset{CH_3}{|}}{C}HX$

80. $XCH_2CH_2OCOCH=CHCOOCH_2CH_2X$

81. $A-CH=CH_2$

82. $CH_3OCOCH=\underset{\underset{R}{|}}{C}-COOCH_3$ wherein the abbreviations X and A used are as previously indicated in the examples given hereinbefore.

Esters of carboxylic acids derived from substituted phenols, which are substituted with a bulky group giving rise to steric hindrance (e.g., isobutyl, dodecyl, hexadecyl, octadecyl and the like, except for di-tert-butyl) at the o-positions, can also be effectively used in the present invention. Specific examples of such esters include:

83.

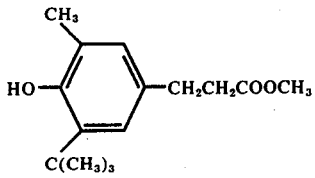

84.

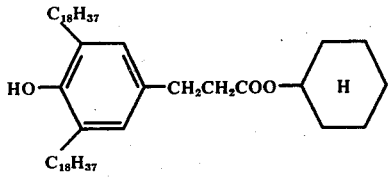

85.

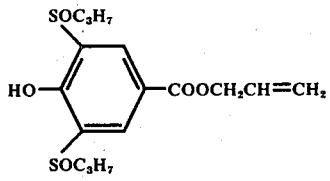

The other class of esters which comprises the important characteristic component (c) of the present invention includes esters of polyhydric phenols in which at least one of the ortho positions is substituted, preferably substituted with a bulky group (as described hereinbefore), and mono- or poly-carboxylic acids.

Preferred reducing agents belonging to this class of esters have the following general formula (II):

(II)

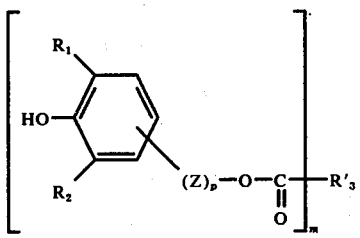

wherein $R_1$ and $R_2$ each has the same meaning as in the general formula (I) of the esters described hereinbefore; $R'_3$ represents a mono- or multi-valent carboxylic acid residue; Z has the same meaning as in the general formula (I); p has the same meaning as in the general formula (I); and m represents a positive integer equal to the valence of the carboxylic acid.

A wide variety of mono- or poly-carboxylic acids can be used as the carboxylic acid component of the esters of the present invention, the residues of which are represented by the symbol $R'_3$ as described above, e.g., comprising the mono- and poly-valent residue groups as herein before described for $R_3$ and include compounds which are regarded as derivatives of not only aliphatic and aromatic hydrocarbons, but also compounds comprising hydrogen, carbon, nitrogen, oxygen, sulfur and similar atoms, in which one or more hydrogen atoms can be replaced by corresponding carboxyl groups. Unsaturated carboxylic acids as well as saturated carboxylic acid can also become the ester component herein. In case of the esters of poly-carboxylic acids, esters containing a few free carboxyl groups which remain unesterified can be used herein.

Most preferred esters belonging to the second class of esters are represented by the following formula, and include esters prepared from 3,5-di-tert-butyl-4-hydroxy group-containing alcohols and mono- or poly-carboxylic acids:

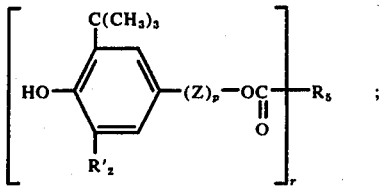

wherein $R'_2$ represents a hydrogen atom or a tertiary butyl group, $R_5$ represents a mono- or multi-valent carboxylic acid residue, e.g., as defined hereinbefore for $R'_3$; r represents a positive integer equal to the valence of the above carboxylic acid residue of $R_5$, Z represents a divalent bonding group, as defined hereinbefore, and p is as hereinbefore defined.

In the above general formula, esters corresponding to the case where Z is a $-(CH_2)_k-$ group, wherein k represents 0 or a positive integer not more than 10, can be easily synthesized and they have excellent heat developing properties. Specific examples of such esters are as follows:

$R'CH_2OCOCH_3$ 86.

$R'CH_2OCOC_{15}H_{31}$ 87.

$R'CH_2OCOC_{17}H_{35}$ 88.

89.

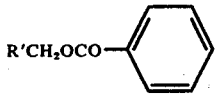

$R'OCO(CH_2)_qOCOR'$ (q = 4,8) 90.

91.

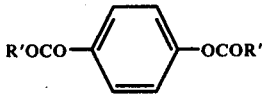

92.

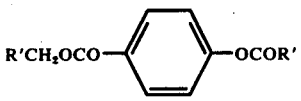

$R'OCOCH_2CH_2SC_{18}H_{37}$ 93.

wherein R′ represents a

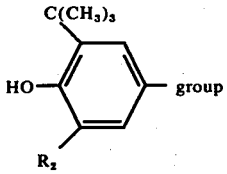

Another effective group of the esters having the above general formula (II) includes the esters derived from phenols sterically hindered by the -OH group and the tertiary butyl group situated on only one of the o-positions thereof, specific examples of which are illustrated below;

94. $QOCO(CH_2)_4COOQ$

95. $QOCOCH_2CH_2SC_{18}H_{37}$ wherein Q represents a

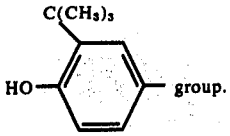

Esters of unsaturated carboxylic acids can also used in the present invention. Specific examples of such esters are as follows;

$R'OCO-CH=CH_2$ 96.

$CH_2=C(CH_3)-COOR'$ 97.

$CH_2=C(CH_3)-COOCH_2CH_2CH_2R'$ 98.

$R'OCOCH=CHCOOR'$ 99.

$CH_3CH_2CH_2CH_2OCOCH_2COOCH_2CH(CH_3)OCOCH_2CH_2R'$ 100.

$R'OCOCH_2)_2C=CH_2$ 101.

$C_6H_5CH=CHCOOR'$ 102.

$CH_3CH=CHCOOR'$ 103.

wherein R′ represents

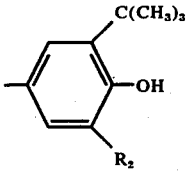

group as described above.

It has been found in the present invention that the combined use of phthaladinone, which can be added as a most advantageous activator and concurrently a color toning agent to the heat developable composition of the present invention as described hereinafter, and the compounds represented by the following general formula can provide images having both a high image density and a preferred black tone:

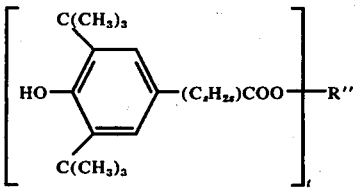

wherein; s represents 1,2,3, or 4, $C_sH_{2s}$ has a carbon atom attached directly to the phenyl nucleus, which has at least one hydrogen atom on the carbon atom attached to that carbon atom, and R″ represents a saturated acyclic aliphatic alcohol residue represented by the formula; $C_dH_{2d+2-t}$, wherein d represents a positive integer ranging from 1 to 6, and t represents a positive integer ranging from 1 to 4d. Specific examples of the esters having the above formula include the esters 12, 13, 15, 16, 17, 18, 26, 27, 35, 37, 41, 42, 43, 45, 46, and 70 as described above.

All of the compounds described above as specific examples are known as effective stabilizing agents for high molecular weight materials.

The above-described compounds of the present invention can be used as a reducing agent not only individually but also as a combination thereof. As is described hereinafter, it is possible in some cases to control the reducing power of the reducing agent of the present invention by use of the reducing agent of the present invention in combination with known reducing agents, which act as an assistant.

The reducing agents of the present invention exhibit their inherent functions if added at any step of the manufacturing process of a heat developable light-sensitive material, but an addition just before the coating-drying procedure of the composition is somewhat preferred because this can reduce the formation of thermal fog.

The reducing agents of the present invention are effective in most cases when used in an amount ranging from about 0.1 mole to about 10 moles, preferably from ⅓ mole to 3 moles, per mole of the organic silver salt component (a).

Organic silver salts of component (a) which can be used in the present invention are moderately stable, white or light yellow silver salts, and can form a silver-image by reacting with the above-described reducing agent component (c) in the presence of the exposed silver halide component (b) when heated at higher than about 80° C, preferably higher than 100° C. Suitable organic silver salts, include silver salts of imino group-, mercapto group- or thione group-, or carboxyl group-containing organic compounds. Specific examples of such organic silver salts are 1. imino group-containing organic silver salts including silver benzotriazole, silver nitrobenzotriazole, silver salts of benzotriazoles substituted with an alkyl group (e.g., silver methylbenzotriazole), with a halogen atom (e.g., silver bromobenzotriazole and silver chlorobenzotriazole), and with a carboimido group

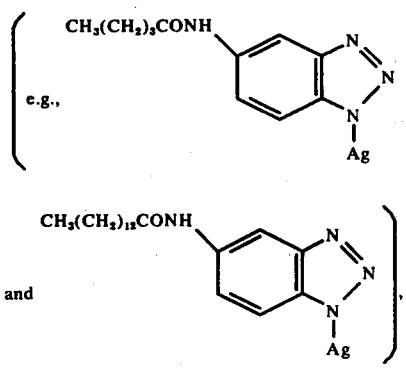

silver substituted benzoimidazoles (e.g., silver 5-chlorobenzoimidazole and silver 5-nitrobenzoimidazole), silver saccharin, silver phthaladinone, silver substituted phthaladinones, silver salts of phthalimides, silver pyrrolidone, silver tetrazole, silver imidazole and the like;

(2) silver salts of mercapto group- or thione group-containing compounds including the silver salt of 3-mercapto-4-phenyl-1,2,4-triazole, the silver salt of 2-mercaptobenzimidazole, the silver salt of 2-mercapto-5-aminothiadiazole, the silver salt of 1-phenyl-5-mercaptotetrazole, the silver salt of 2-mercaptobenzotriazole, the silver salt of 2-(S-ethylthioglycol amido)-benzotriazole, silver salts of thioglycolic acids such as S-$C_{12-22}$alkyl-thioglycolates as disclosed in Japanese Patent Application OPI No. 28211/73, silver salts of dithiocarboxylic acids such as silver dithioacetate, silver thioamide, silver salts of thiopyridines such as silver 5-carbethoxy-1-methyl-2-phenyl-4-thiopyridine, silver salts of dithiohydroxybenzoles, silver salts of mercaptotriazines, silver salts of 2-mercaptobenzoxazoles, silver salts of mercapto-oxadiazoles, and the like;

3. carboxyl group-containing organic silver salts including silver salts of alphatic carboxylic acids such as silver caprate, silver laurate, silver myristate, silver palmitate, silver stearate, silver behenate, silver maleate, silver fumarate, silver tartarate, silver furoinate, silver linolate, silver oleate, silver hydroxystearate, silver adipate, silver sebacate, silver succinate, silver acetate, silver butyrate, silver camphorate, etc., and silver salts of aromatic carboxylic acids and others such as silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, p-phenylbenzoate, silver gallate, silver tannate, silver phthalate, silver terephthalate, silver salicylate, silver phenylacetate, silver pyromellitate, the silver salt of 4'-n-octadecyloxydiphenyl-4-carboxylic acid, silver salts of thiocarboxylic acids as disclosed in U.S. Pat. No. 3,785,830; silver salts of thioether group-containing aliphatic carboxylic acids as disclosed in U.S. Pat. No. 3,330,663; and the like;

4. other silver salts including the silver salt of 4-hydroxy-6-methyl-1,3,3a,7-tetrazaindene, the silver salt of 5-methyl-7-hydroxy-1,2,3,4,6-pentazaindene, silver salts of tetrazaindenes as disclosed in British Pat. No. 1,230,642; silver S-2-aminophenylthiosulfate as disclosed in U.S. Pat. No. 3,549,379; metal-containing aminoalcohols as disclosed in Japanese Pat. application OPI No. 6586/71; organic acid-metal chelates as disclosed in Belgian Pat. No. 768,411 and so on. Oxidizing agents such as titanium oxide, zinc oxide, gold laurate, gold stearate, gold behenate and other gold carboxylates can be optionally used in combination with the above-described organic silver salts.

Various methods of preparing organic silver salts are known. The simplest preparation method comprises mixing a solution of an organic silver salt-forming agent or the salt thereof dissolved in a water-miscible solvent such as an alcohol, acetone, etc., or water with an aqueous solution of a water soluble silver salt such as silver nitrate, as disclosed in U.S. Pat. No. 3,457,075. Moreover, the method of mixing a colloidal dispersion of an ammonium salt or an alkali metal salt of the organic silver salt-forming agent with an aqueous solution of a water soluble silver salt such as silver nitrate can be employed herein, as disclosed in British Pat. No. 1,347,350.

In the above-described methods, an aqueous solution of a silver complex such as a silver ammine complex and the like or a solution of the silver complex dissolved in a water miscible solvent can also be employed instead of using a water solution of a water soluble silver salt such as silver nitrate and the like.

Another method of preparing organic silver salts is described in, for example, U.S. Pat. No. 3,458,544.

Namely, the method of preparation of silver salts of organic carboxylic acids comprises mixing a water-immiscible solution (e.g., benzene solution) containing an organic carboxylic acid with an aqueous solution of a silver complex, wherein the water-immiscible solution is preferably emulsified by adding water thereto before mixing with the aqueous solution of the silver complex. A method similar to the method described above can be employed in the preparation of other organic silver salts.

Still another method of preparing organic silver salts, wherein the resulting organic silver salts are more stable to heat and light, compared with the organic silver salts obtained in the above-described methods, is disclosed in, for example, Japanese Pat. Publication No. 30270/69. Such silver solutions not containing an alkali component as an aqueous solution containing silver nitrate alone are employed instead of silver complexes therein. By using this method, products such as silver benzotriazole can be obtained in high yield. Further a method of preparing organic silver salts is disclosed in, for example, Japanese Pat. application No. 9362/73. This method may be more preferred than all of the above-described methods because heat developable lightsensitive materials prepared by this method have a much more reduced thermal fog (undesirable fog formed at the unexposed areas when the light-sensitive materials are heated). Namely, this method comprises mixing an emulsion, which is prepared from an aqueous solution of the salt of a water soluble organic silver salt-forming agent (e.g., the sodium, potassium, lithium and other alkali metal salts or the ammonium salt) and an oily component (e.g., benzene, toluene, cyclohexane, pentane, hexane, esters of phosphoric acid, esters of carboxylic acids such as acetate esters and oils such as castor oil), with a solution, preferably an aqueous solution, of a silver salt (e.g., silver nitrate, which is more soluble therein than the organic silver salts). As an alternative method of preparing organic silver salts, there is a method of mixing an emulsion, which is prepared from an alkaline aqueous solution (e.g., an aqueous solution of sodium hydroxide) and an oil soluble solution of an organic silver salt-forming agent (e.g., a toluene solution of an organic silver salt-forming agent), with a solution, preferably an aqueous solution, of a water soluble silver salt such as silver nitrate and the like, or a silver complex such as silver ammine complex.

Oily components employed for preparing the above oily solution generally include (1) phosphoric acid esters: e.g., tricresyl phosphate, tributyl phosphate, monoctyl dibutyl phosphate and the like, (2) phthalic acid esters: e.g., diethyl phthalate, dibutyl phthalate, dimethyl phthalate, dioctyl phthalate, dimethoxyethyl phthalate and the like, (3) carboxylic acid esters: e.g., acetic acid esters such as amyl acetate, isopropyl acetate, isoamyl acetate, ethyl acetate, 2-ethylbutyl acetate, butyl acetate, propyl acetate and the like; sebacic acid esters such as diethyl sebacate, dibutyl sebacate, dioctyl sebacate and the like; succinic acid esters such as diethyl succinate and the like; formic acid esters such as ethyl formate, propyl formate, butyl formate, amyl formate and the like; valeric acid esters such as ethyl valarate and the like; tartaric acid esters such as diethyl tartarate and the like; butyric acid esters such as ethyl butyrate, butyl butyrate, isoamyl butyrate and the like; adipic acid esters; (4) oils such as castor oil, cotton seed oil, linseed oil, tsubaki oil and so on, (5) aromatic hydrocarbons such as benzene, toluene, xylene and so on, (6) aliphatic hydrocarbons such as pentane, hexane, heptane and so on, (7) alicyclic hydrocarbons such as cyclohexane, and so on.

As silver complexes, the silver ammine complex, silver methylamine complex and silver ethylamine complex, preferably alkali soluble silver complexes having higher dissociation constants than organic silver salts, are effective used herein.

Organic solvents into which water soluble silver salts such as silver nitrate and so on can be dissolved include polar solvents such as dimethyl sulfoxide, dimethylformamide, acetonitrile, etc., in addition to water. Ultrasonic waves can be effectively employed in the course of preparing organic silver salts as disclosed in Japanese Pat. application No. 7619/73. Particularly, emulsification of water and oil is facilitated by the application of ultrasonic waves. Surface active agents can, of course, be used for the purpose of controlling the grain size of the organic silver salts at the time of preparation thereof.

Moreover, organic silver salts can be prepared in the presence of polymers. As such a special method, the method as disclosed in U.S. Pat. No. 3,700,458 is known, wherein heavy metal salts of organic carboxylic acids such as silver salts thereof are prepared by mixing a non-aqueous solution of an organic carboxylic acid with a non-aqueous solution of a heavy metal salt of trifluoroacetate or tetrafluoroacetate in presence of a polymer. A method wherein an aqueous solution of silver nitrate is allowed to act on a colloidal dispersion of an organic silver salt-forming agent is also described in French Pat. No. 2,147,286. In addition, a method similar to the above by which an emulsion can be prepared in a non-aqueous solution is described in U.S. Pat. No. 3,748,143. Moreover, the coexistence of metal salts or metal complexes containing mercury, lead or the like at the time of preparing the organic silver salts makes it possible to control the grain form, the grain size and photographic characteristics such as thermal fog, stability to light, sensitivity and so on, as disclosed in Japanese Pat. application Nos. 49436/72, 48453/72 and 43867/72.

In addition to the above-described mercury and lead complexes, a metal group including cobalt, manganese, nickel, iron, rhodium, iridium, platinum, gold, cadmium, zinc, lithium, copper, thallium, tin, bismuth, antimony, chromium, ruthenium, palladium and osmium have been confirmed to be effective as such metals. These metal-containing compounds can be used in the form of a mixed solution with or a dispersion into the solution of the silver salt-forming organic compound, which may, then be mixed with an aqueous solution of a water soluble silver salt such as silver nitrate, or an aqueous solution of a silver complex such as silver ammine complex. Three kinds of solutions: a solution or a dispersion of the metal-containing compound, an aqueous solution of a silver salt or a silver complex, and a solution or a dispersion of a silver salt-forming organic compound; can be simultaneously mixed. The procedure of mixing a solution or a dispersion of a silver salt-forming organic compound with a mixture of or a dispersion of a silver salt or a silver complex and a metal-containing compound is also preferred.

The metal-containing compound is effective when used in an amount ranging from about $10^{-6}$ mole to $10^{-1}$ mole per mole of the organic silver salt, and about $10^{-5}$ mole to $10^{-2}$ mole per mole the silver halide.

The grain size of the organic silver salt (a) which is prepared according to the above procedures is about 0.01 to about 10 $\mu$, preferably about 0.1 to about 5 $\mu$, measuring the longer diameter.

The light-sensitive silver halides of component (b) which can be employed in the present invention include silver chloride, silver bromide, silver iodide, silver chlorobromoiodide, silver chlorobromide, silver chloroiodide, silver iodobromide and a mixture thereof. These silver halides are effective when used in an amount ranging from about 0.001 mole to about 0.5 mole, preferably from about 0.01 mole to about 0.3 mole, per mole of the organic silver salt Component (a). Although both coarse and finely divided grains of the light-sensitive silver halide can be effectively used in the present invention, finely divided grains of silver halide are more effective. An appropriate grain size of the silver halide ranges from about 1 $\mu$ to about 0.001 $\mu$, more preferably about 0.5 $\mu$ to about 0.01 $\mu$, measuring the longer diameter. The light-sensitive silver halide can be prepared by methods known in the photographic art such as using the single-jet process, the double-jet process, etc. As examples of such light-sensitive silver halides those prepared by a Lipmann process, an ammonia process, a thiocyanate or thioether-aging process and so on are suitable. The silver halide can be used without washing in the present invention, or can be used after washing with water, an alcohol or other solvents to result in the removal of water soluble salts. Silver halides which can be used in the present invention can be chemically sensitized using chemical sensitizers such as sulfur, selenium, tellurium compounds, gold, platinum, palladium compounds, a reducing agent such as stannous halides and combinations thereof, which are disclosed, for example, in U.S. Pat. Nos. 1,623,499; 2,399,083 and 3,297,447.

Antifogging and stabilizing agents such as thiazolium salts, azaindenes, mercury salts, urazole, sulfocatechol, oximes, nitrons, nitroindazole, etc., can be effectively added to the light-sensitive silver halide emulsions employed in the present invention in order to stabilize against the formation of fog.

These agents are disclosed, for example, in U.S. Pat. Nos. 2,728,663; 2,839,405; 2,556,263 and 2,597,915; and in British Pat. No. 623,448.

Light-sensitive silver halides previously prepared by the above-described procedures can be mixed with a redox composition containing the organic silver salt and the reducing agent, as disclosed in U.S. Pat. No. 3,152,904. In the immediately above-described procedure, the organic silver salt and the reducing agent, however, are not in satisfactory contact with each other, so the resulting silver halides do not possess sufficient sensitivity, as disclosed in U.S. Pat. No. 3,457,075.

Various attempts have been made to achieve sufficient contact of the silver halide with the organic silver salts. One attempt is the use of surface active agents, which is disclosed, for example, in Japanese Pat. application Nos. 8285/73 and 82851/73. Another attempt comprises mixing the silver halide which has already been prepared in a polymer medium with the organic silver salt, as disclosed, for example, in U.S. Pat. Nos. 3,705,565; 3,713,833; 3,706,564 and 3,761,273; French Pat. Nos. 2,107,162 and 2,078,586; and Belgian Pat. No. 774,436.

The silver halides used in the present invention can also be prepared together with organic silver salts substantially simultaneously as disclosed in Japanese Pat. applicaton No. 65727/73. Specifically, the following procedures can be employed; a solution of a silver salt such as silver nitrate, silver complexes, etc., is mixed with a mixture wherein a light-sensitive silver halide-forming component (described hereinafter) is present in a solution or a dispersion of the above-described organic silver salt-forming compound (described hereinbefore) or the salts thereof, or when a solution or a dispersion of the organic silver salt-forming compound or the salt thereof is mixed with a solution of a silver salt such as silver nitrate, silver complexes, etc., a solution of a light-sensitive silver halide-forming component is also added thereto simultaneously. Thus, light-sensitive silver halides can be formed at nearly the same time as the formation of the organic silver salts. Still another process of preparing light-sensitive silver halides which can be used in the present invention comprises conversion of a portion of the organic silver salt into a light-sensitive silver halide by the light-sensitive silver halide-forming component being allowed to act on a solution or a dispersion of the organic silver salt which was previously prepared, or on a sheet material containing the organic silver salt. Since the resulting silver halides will be in efficient contact with the organic silver salts, desirable results can be obtained as described in U.S. Pat. No. 3,457,075.

All compounds which can form silver halides by reacting with organic silver salts can be used herein as light-sensitive silver halide-forming components, Component (b). Which silver halide-forming components are more effective can be easily determined. That is to say, this can be judged by examining the presence of the diffraction peaks characteristic of silver halides by means of X-ray diffraction techniques after the silver halide-forming components has been allowed to act on the organic silver salts and, if necessary, heating the reactants. Specific examples of classes of silver halide-forming components include (1) inorganic halides, for example, halides represented by the general formula $$MX_n'$$

wherein M represents H, $NH_4$ or a metal atom such as lithium, sodium, potassium, rubidium, cesium, copper, gold, beryllium, magnesium, calcium, strontium, barium, zinc, cadmium, mercury, aluminium, gallium, indium, thallium, germanium, tin, lead, antimony, bismuth, chromium, molybdenum, tungsten, manganese, rhenium, iron, nickel, ruthenium, palladium, osmium, iridium, and platinum and so on, X' represents Cl, Br, or I, and $n$ represents 1 when M represents H or $NH_4$, while when M represents a metal atom, $n$ equals the valence of the metal atom. Specific examples of another class of silver halide-forming components include (2) halogen-containing metallic complexes: for example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$, $(NH_4)_3RhBr_6$, and the like. Specific examples of still another class of silver halide-forming components include (3) onium halides: for example, quaternary ammonium halides such as trimethylphenyl ammonium bromide, cetylethyldimethyl ammonium bromide, trimethylbenzyl ammonium, etc.; quaternary-phosphonium halides such as tetraethyl phosphonium bromide; and tertiary sulfonium halides such as trimethyl sulfonium iodide. These onium halides can be added to the final coating dispersion with the intention of increasing the sensitivity, and optionally reducing the density of the background, which is described, for example, in U.S. Pat. No. 3,679,422. Other specific examples of silver halide-forming components include (4) halogenated hydrocarbons (e.g., iodoform, bromoform, carbon tetrabromide, and 2-bromo-2-methylpropane); (5) N-halo compounds (e.g., compounds represented by the following general formula (a) and (b):

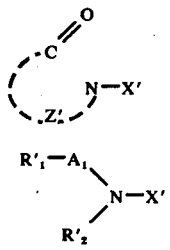

(a)

(b)

wherein X′ represents Cl, Br or I, Z′ represents an atomic group required for the formation of a 5- or 6-membered ring which may be condensed with another ring, $A_1$ represents a carbonyl group or a sulfonyl group, and $R_1'$ and $R_2'$ each represents an alkyl group, an aryl group or an alkoxy group, more specifically N-bromosuccinimide, N-bromophthalimide, N-bromoacetamide, N-iodosuccinimide, N-bromophthalazone and the like, which are described in Japanese Pat. application Nos. 126658/73 and 19760/74; N-halo benzothiazoles which can be substituted with, for example, an alkyl group, a nitro group, a halogen atom, an imido group or an amino group; N-halo benzimidazoles and so on) and (6) other halogen-containing compounds: for example, triphenylmethyl chloride, triphenylmethyl bromide, 2-bromobutyric acid, 2-bromoethanol, benzophenone dichloride and so on.

In both the previous and the present methods, the ripening of the reaction system by allowing the system to stand for an appropriate time (e.g., 20 minutes to 48 hours) at room temperature or at high temperature (30° C – 80° C) after the addition of the silver halide-forming components is effective for improving the quality of the light-sensitive materials, for example, for increasing the sensitivity thereof and for reducing thermal fog. These silver halide-forming components can be used individually or in combination. The silver halide-forming component is effective when used in an amount ranging from about 0.001 mole to about 0.5 mole, preferably about 0.01 mole to 0.3 mole, per mole of the organic silver salt component (a). Use of less than about 0.001 mole results in a reduction in the sensitivity, while use of amount in excess of about 0.5 increases the color change by light (undesirable coloration produced in the background when finished light-sensitive materials are allowed to stand exposed to normal room illumination).

Reducing agents employed for conventional heat developable light-sensitive materials can also be added to the present heat developable light-sensitive materials in addition to the reducing agents characteristic of this invention. Although the suitability of the reducing agents is determined based on the organic silver salts with which it is used in combination, generally suitable reducing agents include substituted phenols, substituted or unsubstituted mono- or bis-naphthols, di- or poly-hydroxy benzenes, di- or poly-hydroxynaphthalene, hydroquinone monoethers, ascorbic acid or the derivatives thereof, 3-pyrazolidones, pyrazoline-5-ones, reducing saccharides, p-phenylenediamine or the derivatives thereof, reductones, kojic acid, hinokitiol, hydroxytetron amides, hydro-oxaminic acids, sulfohydroxyoxaminic acids, hydrazides, indane-1,3-diones, p-oxyphenylglycines and so on. Of these reducing agents, reducing agents which are decomposed on exposure are more preferred in the present invention. Such reducing agents are disclosed in, for example, British Pat. No. 1,163,187. In addition, photolysis-accelerating compounds can be used in combination with the above reducing agents, which are disclosed, for example, in U.S. Pat. No. 3,589,903; and Japanese Pat. application Nos. 81625/73 and 22135/74. As such compounds, reducing agents of the blocked bisphenol system can be effectively used as disclosed in U.S. Pat. No. 3,756,829.

Specific examples of reducing agents other than those of the present invention which can be employed in the present invention are described in, for example, U.S. Pat. Nos. 3,152,904; 3,457,075; 3,531,286; 3,615,533; 3,679,426; 3,672,904; 3,751,252; 3,751,255; 3,782,949; 3,770,448 and 3,773,512; British Pat. No. 1,338,427; Belgian Pat. No. 786,086 and so on. Specific examples of reducing agents are as fllows:

1. SUBSTITUTED PHENOLS:

Aminophenols (e.g., 2,4-diaminophenol, methylaminophenol, p-aminophenol, o-aminophenol, 2-methoxy-4-aminophenol, 2-β-hydroxyethyl-4-aminophenol, etc.); alkyl substituted phenols (e.g., p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol, p-octylphenol, etc.); aryl substituted phenols (e.g., p-phenylphenol, p-phenylphenol, α-phenyl-o-cresol, etc.); and other phenols, for example, p-acetophenol, p-acetoacetyl-4-methylphenol, 1,4-dimethoxyphenol, 2,6-dimethoxyphenol, chlorothymol, 3,5-di-t-butyl-4-hydroxybenzyldimethylamine, sulfonamide phenols, and phenols disclosed in, for example, German Pat. application OLS No. 2,336,395; novolak resin condensates of formaldehyde and phenol derivatives (e.g., 4-methoxyphenol, m-cresol, o- or p-t-butylphenol, 2,6-di-t-butylphenol and mixtures thereof);

2. SUBSTITUTED OR UNSUBSTITUTED BISPHENOLS:

o-Bisphenols, for example, 1,1-bis(2-hydroxy-3,5-dimethylphenyl)-3,5,5-trimethylhexane, bis(2-hydroxy-3-t-butyl-5-methylphenyl)methane, bis(2-hydroxy-3,5-di-t-butylphenyl)methane, bis-(2-hydroxy-3-t-butyl-5-ethylphenyl)methane, 2,6-methylenebis(2-hydroxy-3-t-butyl-5-methylphenyl)-4-methylphenol, 1,1-bis(5-chloro-2-hydroxyphenyl)methane, 2,2′-methylenebis[4-methyl-6-(1-methylcyclohexyl)phenol], 1,1-bis(2-hydroxy-3,5-dimethylphenyl)-2-methylpropane, 1,1,5,5-tetrakis(2-hydroxy-3,5-dimethylphenyl)-2,4-diethylpentane and 3,3′,5,5′-tetramethyl-6,6′-dihydroxy-triphenylmethane; p-bisphenols, for example, bisphenol A, 4,4′-methylenebis(3-methyl-5-t-butylphenol), 4,4′-methylenebis(2,6-di-t-heptylidene)-di-(o-cresol), 4,4′-ethylidene-bis(2,6-di-t-butylphenol), 4,4′-(2-butenylidene)-di-(2,6-xylenol), 4,4'-(p-methylbenzylidene)-di-(o-cresol), 4,4'-(p-methoxybenzylidene)-bis-(2,6-di-tert-butylphenol), 4,4'-(p-nitrobenzylidene)-di-2,6-xylenol) and 4,4'-(p-hydroxybenzylidene)-di-(o-cresol); and others, for example, 3,5-di-t-butyl-4-hydroxybenzyldimethylamine, α,α'-(3,5-di-t-butyl-4-hydroxyphenyl)dimethyl ether, 2,4,6-tris(3,5-di-t-butyl-4-hydroxybenzyl)phenol, N,N'-di(4-hydroxyphenyl) urea, polyphenols such as tetrakis[-methylene-(3,5-di-t-butyl-4-hydroxyhydrocinnamate]methane, diethylstilbestrol, hexestrol, bis-(3,5-di-t-butyl-4-hydroxybenzyl) ether, 2,6-bis(2'-hydroxy-3'-t-butyl-5'-methylbenzyl)-4-methylphenol and so on,

3. SUBSTITUTED OR UNSUBSTITUTED MONO- OR BIS-NAPHTHOLS AND Di- or Poly-hydroxynaphthalenes:

bis-β-Naphthols (e.g., 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl); naphthols (e.g., α-naphthol, β-naphthol, 1-hydroxy-4-amino-naphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, sodium 1-amino-2-naphthol-6-sulfonate, 1-naphthylamine-7-sulfonic acid; and sulfonamide naphthols;

4. DI- OR POLY-HYDROXYBENZENES, AND HYDROQUINONE MONOETHERS (as disclosed, for example, in German Patent Application OLS NO. 2,336,395):

hydroquinone; alkyl substituted hydroquinones (e.g., methylhydroquinone, t-butylhydroquinone, 2,5-dimethylhydroquinone, 2,6-dimethylhydroquinone, t-octylhydroquinone and so on); halo-substituted hydroquinones (e.g., chlorohydroquinone, dichlorohydroquinone, bromohydroquinone and so on); alkoxy substituted hydroquinones (e.g., methoxyhydroquinone, ethoxyhydroquinone and so on); other hydroquinones, for example, phenylhydroquinone and hydroquinone monosulfate; hydroquinone monoethers (e.g., p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether, hydroquinone mono-n-hexyl ether and so on); and others, for example, catechol, pyrogallol, resorcinol, 1-chloro-2,4-dihydroxybenzene, 3,5-di-t-butyl-2,6-dihydroxy-benzoic acid, 2,4-dihydroxy benzoic acid, 2,4-dihydroxyphenol sulfide, methyl gallate, propyl gallate and so on;

5. ASCORBIC ACID AND DERIVATIVES THEREOF:

l-Ascorbic acid; isoascorbic acid; ascorbic acid monoethers (e.g., ascorbic acid monolaurate, ascorbic acid monomyristate, ascorbic acid monopalmitate, ascorbic acid monostearate, ascorbic acid monobehenate and the like); ascorbic acid diesters (e.g., ascorbic acid dilaurate, dimyristate, dipalmitate, distearate and the like thereof); and other ascorbic acids as disclosed in U.S. Pat. No. 3,337,342;

6. 3-PYRAZOLIDONES AND PYRAZOLONES:

1-Phenyl-3-pyrazolidone, 4-methyl-4-hydroxymethyl-1-phenyl-3-pyrazolidone, 3-pyrazolidone as disclosed in British Patent No. 930,572, 1-(2-quinolyl)-3-methyl-5-pyrazolone and so on;

7. REDUCING SACCHARIDES:

Glucose, lactose and the like,

8. PHENYLENEDIAMINES:

N,N-Dialkyl-p-phenylenediamines such as N',N'-diethyl-p-phenylenediamine, N-phenyl-N'-isopropyl-p-phenylenediamine, etc., which can provide a color image by the combined use of phenol group- or active methylene-containing color couplers as disclosed in U.S. Pat. No. 3,531,286 and which can also provide a color image according to the procedure as described in U.S. Pat. No. 3,761,270;

9. HYDROXYLAMINES:

N,N-Di(2-ethoxyethyl)hydroxylamine and the like,

10. REDUCTONES:

Anhydro-dihydro-aminohexose reductones as disclosed in U.S. Pat. No. 3,679,426; linear-amino reductones as disclosed in Belgian Pat. No. 786,086 and the like;

11. HYDRO-OXAMINIC ACIDS:

Hydro-oxaminic acids as disclosed in U.S. Pat. Nos. 3,751,252 and 3,751,255;

12. HYDRAZIDES:

Arylhydrazides of hydroxy group substituted fatty acids as disclosed in U.S. Pat. No. 3,782,949;

13. OTHER REDUCING AGENTS:

Pyrazoline-5-ones as disclosed in U.S. Pat. No. 3,770,448; indane-1,3-diones in which a hydrogen atom is present in at least either of the 2-positions, as disclosed in U.S. Pat. No. 3,773,512; amidoximes as disclosed in U.S. Pat. No. 3,794,448; other reducing agents as disclosed in U.S. Pat. No. 3,615,533 and German Pat. application OLS No. 2,031,748. In addition, reducing agents which readily undergo photolysis upon light-exposure, and which include ascorbic acid or derivatives thereof, furoin, benzoin, dihydroxyacetone, glycerin aldehyde, tetrahydroxyquinone rhodizonate, 4-methoxy-1-naphthol and so on, are preferred herein because these reducing agents are decomposed by light when followed to stand in a bright room after the development of light-sensitive materials to result in their no longer acting as reducing agents and their not causing discoloration of the light-sensitive materials. Moreover, a positive image can be directly obtained by an image-exposure because such reducing agents exisiting at the part corresponding to the image are destroyed by light. This is described in Japanese Pat. Publication Nos. 22185/70 and 41865/71.

It is well known that a suitable combination of the organic silver salt oxidizing agent (a) and the reducing agent (c) used in combination therewith must be selected according to the oxidizing power thereof. Esters derived from phenols with steric hindrance which can be effectively used in the present invention are especially suitable for the silver salts respectively easy to be reduced such as silver caprate, silver laurate, silver palmitate, silver stearate, etc. However, in case of silver salts comparatively difficult to be reduced such as silver benzotriazole, silver behenate and the like, the reducing agents of the present invention are to be used together with an auxiliary developer which has a stronger reducing power. Namely, 1-phenyl-3-pyrazolidones, ascorbic acid, 4-methoxy-1-naphthol and the like are suitable auxiliary developers for silver benzotriazole, and for silver behenate, auxiliary developers such as o-bisphenols, hydroquinones and the like are suitable. A solution proportion of these reducing agents to the compounds of the invention ranges from about 0.1 mol % to about 10 mol %.

Although a suitable amount of the auxiliary reducing agent or developer extends over a wide range because it depends upon the reducing power of the auxiliary reducing agent and the reducibility of the oxidizing agent of the organic silver salt, a generally effective amount ranges from about $10^{-5}$ mole to 1 mole, preferably from $10^{-3}$ mole to 0.8 mole, per mole of the main reducing agent of the present invention. The most striking aspect of the combined use of the reducing agent of the present invention and the above-described auxiliary reducing agent is that development can be controlled and reduced fog, increased whiteness and stabilization to light after processings can be obtained in a similar manner as with individual use of the main reducing agent.

Color toning agents which are an additive used in combination with the above-described reducing agents can be preferably used when a dark tone, especially a black tone, resulting image is desired. The color toning agent is effective when used in an amount ranging from about 0.0001 mole to about 2 mole, preferably from about 0.0005 mole to about 1 mole, per mole of the organic silver salt. The selection of an effective color toning agent depends on the organic silver salt and the reducing agent employed in combination therewith. Most commonly used color toning agents include heterocyclic organic compounds which contain at least two hetero atoms in the molecule, and containing heterocyclic rings with at least one nitrogen atom in the ring. These color toning agents are disclosed in, for example, U.S. Pat. No. 3,080,254.

Specific examples of color toning agents are phthalazone (phthalazinone), phthalic anhydride, 2-acetylphthalazinone, 2-phthalylphthalazinone and the like. Another preferred class of color toning agents includes substituted phthalazinones as disclosed in Japanese Pat. application No. 116022/73. Still another class of color toning agents includes pyrazoline-5-ones, cyclic imides, and quinozolines. Specific examples of these compounds are phthalimide, N-hydroxyphthalimide, N-potassiumphthalimide and N-silver phthalimide as disclosed in Japenese Pat. application (OPI) No. 6077/71. Silver phthalazinone is also useful as a color toning agent.

Other effective classes of color toning agents include the mercapto compounds as disclosed in Japanese Pat. Publication Nos. 41967/72 and 41969/72; oxazinediones as disclosed in Japanese Pat. application No. 50427/73; phthalazinediones; uracils as disclosed in Japanese Pat. application No. 17378/74; N-hydroxynaphthalimides; substituted phthalimides as disclosed in German Pat. application OLS Nos. 2,140,406; 2,141,063 and 2,220,597; and phthalazinone derivatives as disclosed in German Pat. application OLS No. 2,220,618.

Each component of the present invention should be incorporated in at least one kind of colloid which is used as a binder. Hydrophobic binders are generally preferred, but hydrophilic binders can also be used. Such binders are preferably transparent or translucent. Suitable binders for the present invention include natural substances such as gelatin, proteins such as gelatin derivatives, cellulose derivatives, polysaccharides such as dextran, and gum arabic, especially advantageously latexlike vinyl polymers and synthetic polymers described hereinafter which increase the dimensional stability of photographic materials. Suitable preferred synthetic polymers for binders are those described in the specifications of U.S. Pat. Nos. 3,142,586; 3,193,386; 3,062,674; 3,220,844; 3,287,289; and 3,411,911.

Examples of effective polymers, include water insoluble polymers prepared from alkyl acrylates, alkyl methacrylates, acrylic acid, sulfoalkylacrylates or sulfoalkylmethacrylates, and cyclic sulfobetaine unit-containing polymers as disclosed in Canadian Pat. No. 774,054. As examples high molecular weight resins which are quite suitable as binders, mention may be made of polyvinyl butyral, polyacrylamide, cellulose acetate butyrate, cellulose acetate propionate, polymethylmethacrylate, polyvinylpyrrolidone, polystyrene, ethyl cellulose, polyvinyl chloride, chlorinated rubber, polyisobutylene, butadiene-styrene copolymer, vinyl chloride-vinyl acetate copolymer, vinyl acetate-vinyl chloride-maleic acid copolymer, polyvinyl alcohol, polyvinyl acetate, benzylcellulose, cellulose acetate, cellulose propionate, cellulose acetate phthalate and so on. Of these polymers, particularly preferred polymers are polyvinyl butyral, polyvinyl acetate, ethylcellulose, polymethylmethacrylate, and cellulose acetate butyrate. These binders can be used individually or as a combination thereof. A suitable amount of the binder is a weight ratio ranging from about 10:1 to about 1:10, preferably about 4:1 to about 1:4, per unit of organic silver salt of the component (a).

Various kinds of supports can be suitably used in the present invention, on which layers containing each of the components and other layers described in the present specification are coated. Typical supports which can be employed in the present invention include synthetic resin films such as cellulose nitrate films, cellulose ester films, partially acetylated synthetic resin films, polyvinyl acetal films, polyethylene films, polyethylene terephthalate films, polycarbonate films, etc., glass, paper, metals such as aluminium, and the like. Moreover, baryta paper, resincoated paper and waterproof paper can be suitably used as a support. Supports with plasticity are still even more preferred from the standpoint of treatments thereof. Processed paper processed with clay such as art paper, coated paper, etc., is also suitable for paper supports. Further, paper sized with polysaccharides is useful.

A suitable coating amount of silver, arising from both the organic silver salt and the silver halide, coated on a support is a coverage ranging from about 0.2 g to about 3 g, preferably about 0.3 g to about 2 g, per square meter. A coverage of less than about 0.2 g of silver does not provide an image of sufficient density, while a coverage in excess of about 2 g becomes rather expensive and substantially no improvement in the photographic characteristics resulting from such an excess is obtained.

Some kinds of optical sensitizing dyes which are known to be useful for gelatin-silver halide emulsions are also suitable for use in the present heat developable light-sensitive material in order to further increase the sensitivity. Effective optical sensitizing dyes include cyanines, merocyanines, complex (trinuclear or tetranuclear) cyanines, holopolar hemicyanines, oxonols, hemioxonols and so on. Of the cyanine dyes, those containing basic nuclei such as thializoline, oxazoline, pyrroline, pyridine, oxazole, thiazole, selenazole and imidazole nuclei are preferred. Such basic nuclei each can be substituted with an alkyl group, an alkylene group, a sulfoalkyl group, a carboxyalkyl group, an aminoalkyl group or an enamine group which can form a condensed carbon ring or a heterocyclic ring. Either symmetric or asymetric cyanine dyes can be used herein. Moreover, an alkyl group, a phenyl group, an enamine group or a heterocyclic ring can be substituted on the methine chain or the polymethine chain or each of the above-described cyanines. Carboxyl group-containing cyanine dyes are particularly effective in increasing the sensitivity. In addition to containing the above-described basic nuclei, merocyanine dyes can contain acidic nuclei such as thiohydantoin, rhodanine, oxazolidinedione, thiazolidinedione, barbituric acid, thiazolineone and malononitrile nuclei. These acidic nuclei can be further substituted with alkyl groups, alkylene groups, phenyl groups, carboxyalkyl groups, sulfoalkyl groups, hydroxyalkyl groups, alkoxyalkyl groups, alkylamino groups or heterocyclic nuclei. Imino or carboxy group-containing merocyanine dyes are particularly useful for increasing the sensitivity. These dyes can be used individually or as a combination thereof. Further, hypersensitizing additives which do not absorb visible light as disclosed in the specifications of U.S. Pat. Nos. 2,933,390; 2,937,089; etc., for example, ascorbic acid derivatives, azaindenes, cadmium salts, organic sulfonic acids and so on can be used in combination with the above-described merocyanine dyes.

Particularly suitable sensitizing dyes for the heat developable light-sensitive materials of the present invention include merocyanine dyes having a rhodanine, a thiohydantoin or a 2-thio-2,4-oxazolidinedione nucleus as disclosed in Japanese Pat. application (OPI) No. 6329/72. Specific examples of these dyes are 3-p-carboxyphenyl-5-[β-ethyl-2-(3-benzoxazolylidene)-ethylidene]rhodanine, 5-[(3-β-carboxyethyl-2-(3-thiazolinylidene)-ethylidene]-3-ethylrhodanine, 3-carboxymethyl-5-[(3-methylthiazolinylidene)-α-ethyl-ethylidene]rhodanine, 1-carboxymethyl-5-[(3-ethyl-2-(3H)-benzoxazolylidene)ethylidene]-3-phenyl-2-thiohydaintoin, 5-[(3-ethyl-2-benzoxazolinidene)-1-methyl-ethylidene]-3-[(3-pyrroline-1-yl)propyl]rhodanine and 3-ethyl-5-[(3-ethyl-2-(3H)-benzothiazolylidene)isopropylidene]-2-thio-2,4-oxazolidenedione. Other effective sensitizing dyes for the heat developable light-sensitive materials of the present invention include trinuclear merocyanine dyes as disclosed in U.S. Pat. No. 3,719,495; polycyclic aromatic dyes as disclosed in Belgian Pat. No. 788,695; sensitizing dyes quite suitable for silver iodide as disclosed in Japanese Pat. application No. 56332/72; styryl quinoline series dyes as disclosed in Japanese Pat. application No. 127999/72; rhodacyanine dyes as disclosed in Japanese Pat. application No. 14916/73, acidic dyes such as 2′,7′-dichlorofluorescein dye as disclosed in Japanese Pat. application Nos. 7624/73, 12587/73, 50903/73 and 81550/73; and merocyanine dyes as disclosed in Japanese Pat. application No. 10815/74. These dyes can be used in an amount ranging from about $10^{-4}$ mole to about 1 mole per mole of the silver halide or silver halide-forming component, Component (b).

The heat developable light-sensitive material of the present invention can also contain on the support thereof an antistatic layer or an electrically conductive layer. These layers can contain, for example, halides, water soluble salts such as nitrate, ionic polymers as disclosed in U.S. Pat. Nos. 2,861,056 and 3,206,312; and further, water insoluble inorganic salts as disclosed in U.S. Pat. No. 3,428,451. Moreover, the heat developable light-sensitive material of the present invention can have a thin metallic film evaporated onto a support. In addition, anti-halation materials or anti-halation dyes can be optionally incorporated in the heat developable light-sensitive material of the present invention. Suitable dyes for anti-halation are those which are decolored by the application of heat. For example, dyes such as those described in U.S. Pat. Nos. 3,769,019; 3,745,009 and 3,615,432 are preferred. Further, filter dyes and light-absorbing compounds as disclosed in U.S. Pat. Nos. 3,253,921; 2,527,583 and 2,956,879 can be incorporated in the heat developable light-sensitive material of the present invention.

heat developable light-sensitive materials of the present invention can optionally contain matting agents such as starch; titanium dioxide; zinc oxide; silica; polymer beads as disclosed in U.S. Pat. Nos. 2,922,101 and 2,761,245; kaolin; and clay. They can further contain fluorescence-increasing agents such as the stilbenes, triazines, oxazoles and coumarins. These flourescence-increasing agents may be used in the form of an aqueous solution or a dispersion.

The heat developable light-sensitive materials employed in the present invention can further contain plasticizers and lubricants. Preferable plasticizers and lubricants include glycerin; diols; polyhydric alcohols, for example, as disclosed in U.S. Pat. No. 2,960,404; fatty acids or the esters thereof, for example, as disclosed in U.S. Pat. Nos. 2,588,765 and 3,121,060; and silicone resins, for example, as disclosed in British Pat. No. 955,061. Moreover, surface active agents, for example, saponin and alkylarylsulfonates as disclosed in U.S. Pat. No. 2,600,831; amphoteric compounds as disclosed in U.S. Pat. No. 3,133,816; and the adducts of glycidol and alkylphenols as disclosed in British Pat. No. 1,022,878; can be incorporated in the heat developable light-sensitive materials of the present invention.

Some layers of the heat developable light-sensitive layers of the present invention which are capable of being hardened can be hardened using various kinds of organic or inorganic hardening agents. The hardening agents can be used either singly or in combination. Examples of suitable hardening agents include aldehydes, blocked aldehydes, ketones, carboxylic acids or carboxylic acid derivatives, sulfonate esters, sulfonyl halides and vinyl sulfonyl esters, active halogen containing compounds, epoxy compounds, aziridines, active olefin containing compounds, isocyanates, carbodiimides and polymer hardeners such as dialdehyde starch.

Various kinds of additives can be employed for further increasing the image density. For example, nonaqueous polar organic solvents containing a

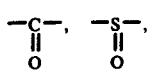

or $-SO_2-$ group such as tetrahydrothiophene-1, 1-dioxide, 4-hydroxybutanoic acid lactone and methylsulfinyl methane, which are disclosed in, for example, U.S. Pat. No. 3,667,959, can be effectively used. Other effective additives are acetic acid salts of zinc, cadmium and copper as disclosed in U.S. Pat. No. 3,708,304. Further, water of crystallization-containing compounds as disclosed in Japanese Pat. Publication Nos. 26582/69 and 18416/70, acidic salts of amines and metal oxides or hydroxides which become alkaline upon heating can be effectively used for accelerating the development of heat developable light-sensitive materials. In addition, the combined use of a polyalkylene glycol and a mercaptotetrazole also improves the sensitivity, the contrast and the image density, as disclosed in U.S. Pat. No. 3,666,477.

Various methods can be employed in protecting the heat developable light-sensitive materials of the present invention against thermal fog. One method comprises the addition of mercury compounds, as disclosed in Japanese Pat. Publication No. 11113/72. Mercury compounds can provide a method of directly forming positive images as disclosed in, for example, U.S. Pat. No. 3,589,901. The combined use of mercury compounds and color couplers also provides a stable color image as disclosed in, for example, U.S. Pat. No. 3,764,328. The following procedures can be further added to the above process; one procedure is the addition of mercury compounds or some kind of N-halides before heating the sensitive materials to stabilize to light, and another procedure is the application of a preheating step before the image-exposure in order to provide high sensitivity to the sensitive materials, as disclosed in Japanese Pat. application (OPI) Nos. 80030/73, 51626/73, 89720/73 and 10039/74; and German Pat. application OLS No. 2,315,233. Moreover, the application of heat before the image-exposure can be employed in order to make it possible to control the sensitivity and contrast, as disclosed in Japanese Pat. application (OPI) No. 43630/73.

Another method for preventing thermal fog comprises using N-halo-compounds such as N-halosuccinimide and N-haloacetamide, as disclosed in Japanese Pat. application (OPI) No. 10724/74 and Japanese Pat. application Nos. 8194/73 and 2842/73. Still another method for preventing thermal fog comprises the addition of acid stabilizers, for example, higher fatty acids such as lauric acid, myristic acid, palmitic acid, stearic acid and behenic acid; tetrahalophthalic acid or the anhydride thereof; aryl sulfonic acids such as benzene sulfonic acid and p-toluene sulfonic acid; aryl sulfinic acids such as benzene sulfinic acid and p-toluene sulfinic acid or aryl sulfinates; and salts of higher fatty acids such as the lithium salts, as disclosed in U.S. Pat. No. 3,645,739; Japanese Pat. application Nos. 37965/73, 44935/73 and 10672/73; and Japanese Pat. application (OPI) No. 89720/73. Another class of effective acid stabilizers includes alkyl substituted benzoic acids such as salicylic acid, p-hydroxybenzoic acid, tetrabromobenzoic acid, tetrachlorobenzoic acid; p-acetamidobenzoic acid and p-t-butylbenzoic acid; phthalic acid; isophthalic acid; trimellitic acid; pyromellitic acid, diphenic acid, 5,5'-methylenebissalicylic acid and the like. In addition to preventing thermal fog, these acid stabilizers prevent the finished sensitive materials from discoloring when exposed to white light, increase the image density, and improve the photographic characteristics so that the properties possessed just after production are maintained after storage.

Another class of compounds which can effectively protect the heat sensitive materials against thermal fog include benzotriazole and derivatives thereof, thiouracils such as 2-thiouracils represented by the following formula;

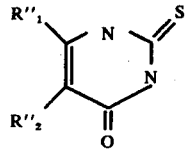

(wherein $R''_1$ represents H, OH, an alkoxy group, a halogen atom, a lower unsubstituted or substituted alkyl group, a benzyl group, an allyl group, an amino group, a nitro group or a nitroso group, and $R''_2$ represents H, OH, a halogen atom, an amino group, an acetamido group, an unsubstituted or substituted alkyl group having 1 to 22 carbon atoms, a phenyl group or a substituted aryl group), mercapto compounds such as 1-phenyl-5-mercaptotetrazole, azole thioethers or blocked azolethiones, peroxides or persulfates as disclosed in Japanese Pat. application No. 5453/74 and so on. In addition, when chromium salts, rhodium salts, copper salts, nickel salts, cobalt salts, rhodium, iron and cobalt complexes are allowed to coexist in the reaction system during or before the formation of the silver halides, the resulting sensitive materials have improved photographic characteristics such as a further increased thermal fog-preventing property and a further increased sensitivity.

Heat developable light-sensitive materials of the present invention can effectively contain a precursor of stabilizers such as azole thioethers and azole thiones as disclosed in Japanese Pat. application (OPI) No. 318/72; tetrazolythio-compounds as disclosed in U.S. Pat. No. 3,700,457; and light-sensitive halogen-containing organic oxidizing agents as disclosed in U.S. Pat. No. 3,707,377.

In addition to the above-described additives, light-absorbing dyes as disclosed in Japanese Pat. Publication No. 33692/73 can be added in order to enhance the resolving power. Leuco dye compounds as disclosed in Japanese Pat. application No. 110287/73 can also be incorporated in heat developable light-sensitive materials of the present invention in order to improve the photographic properties so that the properties possessed immediately after production are maintained on storage. As disclosed in Japanese Pat. application No. 22135/74, blue dyes such as Victoria Blue can be used in order to improve the whiteness of the unexposed area, because they can reduce the residual color of dyes by a blueing technique. The finished light-sensitive materials can be further stabilized to light and heat in some cases. As examples of effective methods for such stabilization, mention can be made of a method of stabilizing with a mercapto compound-containing solution as disclosed in U.S. Pat. No. 3,617,289; and another method of stabilizing by putting a laminate layer containing a stabilizing agent as a top coat of the finished light-sensitive material as disclosed in Japanese Pat. application No. 102337/73.

A top coat of a polymer film can be optionally provided on the light-sensitive layer of the present heat developable light-sensitive material in order to increase the transparency thereof, to enhance the image density thereof and to improve the photographic properties thereof so that the properties possesssed immediately after production are maintained on storage, as disclosed in Japanese Pat. application (OPI) No. 6917/74. The thickness of the top coat of the polymer film preferably ranges from about 1 $\mu$ to 20 $\mu$.

Examples of effective polymers which can be top coated on the light-sensitive layer include polyvinyl chloride, polyvinyl acetate, vinyl chloride-vinyl acetate copolymers, polystyrene, polymethylmethacrylate, methylcellulose, ethylcellulose, cellulose acetate butyrate, cellulose acetate, polyvinylidene chloride, cellulose propionate, cellulose acetate phthalate, polycarbonate, cellulose acetate propionate, polyvinyl pyrrolidone and so on.

In addition, incorporation of a material such as kaolin, silica, polysaccharides such as starch, etc., in the top coat polymer film are especially preferred because writing on the material with a ball-point pen or a pencil becomes possible. Moreover, filter dyes, ultraviolet light-absorbing agents and acid stabilizers such as higher fatty acids and the like can be incorporated in the top coat of the polymer film.

Heat developable light-sensitive layers, the top coat of the polymer film, subbing layers, a back layer and other layers which comprise the layers of the light-sensitive material of the present invention can be coated according to various kinds of coating techniques. Suitable coating techniques for the present invention include a dipping, an air-knife, a curtain coating and a hopper coating technique. Two or more layers can be optionally coated simultaneously according to the methods as disclosed in U.S. Pat. No. 2,761,791 and British Pat. No. 837,095.

The photographic characteristics of the heat developable light-sensitive materials of the present invention, in analogy with other common heat developable light-sensitive materials, tend to deteriorate when contacted with moisture, in general. It is, therefore, preferred that the coated sensitive materials are packed together with a drying agent when placed in the trade, as disclosed in Japanese Pat. application No. 50429/73.

The heat developable light-sensitive materials which are embodied in the present invention can have a subbing layer between a supporting layer and the heat developable light-sensitive layers. Various kinds of polymers described previously can be employed as a binder for the above subbing layer. These polymers include polyvinyl butyral, polyacrylamide, cellulose acetate butyrate, cellulose acetate propionate, polymethylmethacrylate, polystyrene, polyvinyl pyrrolidone, ethylcellulose, polyvinyl chloride, chlorinated rubber, polyisobutylene, butadiene-styrene copolymers vinyl chloride-vinyl acetate copolymers, vinyl acetate-vinyl chloride-maleic acid copolymers, polyvinyl alcohol, polyvinyl acetate, cellulose acetate, cellulose propionate, cellulose acetate phthalate, gelatin, gelatin derivatives, polysaccharides and so on. The subbing polymer layer can further contain fatty acids or the salts thereof to result in an improvement in the photographic characteristics such as discoloration by light and thermal fog. Further, the incorporation of a pigment such as clay into the subbing layer can prevent solvents permeating into the sensitive layers. In addition to the above additives, matting agents such as silica, kaolin, titanium dioxide, zinc oxide, etc., can be incorporated into the subbing layer. Moreover, a conductive metal layer formed by electrodeless plating can be used as a subbing layer. In addition, a hydrophobic polymer layer is preferably coated on the back side of a paper support with the intention of increasing the moisture resistance and protecting against curling.

The heat developable light-sensitive materials which are prepared according to the above procedures can be cut into an appropriate size, and then exposed imagewise. As previously mentioned, they can be pre-heated to about 80° C to 140° C before exposure. Light sources suitable for providing appropriate radiation for the image-exposure in the present invention include a tungsten lamp, a fluorescent lamp for copying mainly used for the exposure of diazo light-sensitive materials, a mercury lamp, a xenon lamp, a CRT light-source, a laser light-source and so on. As originals, not only line-drawing images such as draftings but also photographic images with gradation, portraits and scenic images taken with a camera can be used in the present invention. Printing techniques applicable to the present invention include contact printing wherein the original is closely superposed on the sensitive material, reflection printing and enlargement printing.

The amount of exposure will depend upon the sensitivity of the sensitive material used. In general, sensitive materials of high sensitivity are preferably exposed for about 10 lux.second while sensitive materials of low sensitivity for about $10^4$ lux.second The resulting image-exposed light-sensitive material can, then, be developed simply by heating (e.g., up to about 80° C to about 180° C, preferably about 100° C to about 150° C). The heating time for development can be appropriately adjusted. An effective developing time generally ranges from about 1 second to 60 seconds. The heating time depends upon the heating temperature, and can be experimentally determined. Appropriate conditions for heating are usually about 5 to 40 seconds at 120° C, about 2 to 20 seconds at 130° C and about 1 to 10 seconds at 140° C.

Various means for heat-development can be used in the present invention. For example, the materials can be developed by being allowed to come into contact with a simple heated plate or a heated drum, and alternatively, by being passed through a heated space. In still another case, they can be developed by heating with high frequency waves or a laser beam. The odor generated from the sensitive materials when heated can be prevented by using a processing machine equipped with a deodorizer. Some types of perfumes can also be incorporated in the heat developable sensitive material so that the odor therefrom is not perceived or not objectionable.

A method of preparing the heat developable light-sensitive material employed in the present invention is illustrated generally below, and it is illustrated in greater detail by reference to the examples described hereinafter. Namely, the organic silver salt-forming agent was allowed to react with a silver ion-donating agent (e.g., silver nitrate) according to one of the previously described methods, resulting in the formation of the organic silver salt Component (a). The preparation was usually carried out under atmospheric pressure and at a temperature ranging from about −15° C to +80° C, preferably about 20° C to about 60° C. The resulting organic silver salt was washed and rinsed with water, alcohol or the like. Then, it was dispersed into a binder for producing an emulsion by using a colloid-mill, a mixer or a ball-mill. The dispersing process was usually carried out at ordinary temperature (about 15° C–25° C). A silver halide-forming agent was added to the resulting polymer dispersion of the silver salt, which will convert some part of the organic silver salt to the corresponding silver halide. An appropriate temperature for the above conversion reaction was within the range of ordinary temperature to 80° C. The reaction time suitable for the above conversion reaction can be arbitrarily selected within the range of up to 48 hours. As previously described, a silver halide which had already been prepared might also be added to the above polymer dispersion, or silver halide and the organic silver salt could be prepared at the same time. Various kinds of additives such as sensitizing dyes, reducing agents, a color-toning agent and so on were then added successively. Usually, they were added in turn with stirring at a temperature ranging from ordinary temperature to about 50° C at appropriate time intervals (usually about 5 to 20 minutes). A coating solution prepared in this way was coated on an appropriate support by means of a coating machine. The coating solution was adjusted to an appropriate temperature ranging from about 5° C to 50° C. Drying was carried out at an appropriate temperature ranging from about 3° C to 100° C. A suitable coating speed for the present invention was selected within the range of about 3 m/min. to 150 m/min. The coating of the top-coat polymer film was optionally carried out under the same conditions as above. Further, a subbing layer was previously coated similarly, and if necessary, a back layer was also coated. On the other hand, these layers can be coated simultaneously.

In accordance with an embodiment of the present invention, heat developable light-sensitive materials having reduced thermal fog after heat development, increased whiteness and excellent stability to light can be obtained.

The present invention will now be illustrated in greater detail by reference to the following examples. Unless otherwise indicated herein, all parts, percents, ratios and the like are be weight.

EXAMPLE 1

1.9 g of sodium hydroxide was dissolved in 100 ml of water, with which 12 g of lauric acid in 100 ml of toluene was mixed to emulsify (at 25° C). An aqueous solution of 8.5 g of silver nitrate dissolved in 50 ml of water was, then, added to the above emulsion to result in a separation into a silver laurate-containing toluene phase and an aqueous phase. After removal of the aqueous phase, the toluene phase was dispersed into 200 ml of ethanol, and then, silver laurate was collected by centrifuging. 12 g of spindle-like silver laurate crystals of a longer diameter of about 3 $\mu$ was obtained.

(Instead of toluene which was used in the above procedure, benzene, pentane, cyclohexane, butyl acetate, isoamyl acetate, butyl alcohol, tricresyl phosphate, dibutyl phthalate and the like are also suitable, and in a similar manner to the above silver laurate can be obtained.)

A polymer dispersion of the silver salt was prepared by dispersing 6 g of the resulting silver laurate (about 0.02 mole and 12 g of polyvinyl butyral (or 12 g of ethylcellulose) into 70 g of ethyl alcohol using a mixer. (As the dispersing medium, methanol, propanol and isopropanol can be employed instead of the ethyl alcohol, which gives the same results as above.) The polymer dispersion of the silver salt was maintained at 50° C. 0.15 g of N-bromosuccinic imide (silver halide-forming component) was then added to the above polymer dispersion with stirring, and then the resultant dispersion was allowed to stand for 90 minutes with stirring. (Instead of N-bromosuccinic imide, N-bromoacetoamide, N-bromophthalazinone and other halo compounds can be employed in a similar manner.)

After cooling the resultant dispersion at 30° C, a heat developable light-sensitive coating solution was prepared by adding the components set-forth below in their listed order every 5 minutes to the above resultant dispersion with stirring.

COMPONENT

| | | |
|---|---|---|
| (a) | Sensitizing Dye* (0.025 wt% methyl Cellosolve solution) | 10 ml |
| (b) | Phthalazone (color toning agent) (3 wt% methanol solution) | 100 ml |
| (c) | Reducing Agent tetrakis[Methylene-(3,5-di-t-butyl-4-hydroxyhydrocinnamate)]methane (Compound 65) (20% acetone solution) | 25 ml |

*A merocyanine dye represented by the following formula:

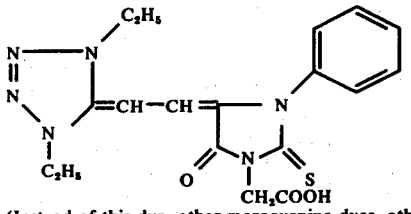

(Instead of this dye, other merocyanine dyes, other cyanine dyes and acidic dyes can be employed in a similar manner.)

The resulting coating solution was then coated on a support (e.g., art paper, coated paper, photographic raw paper, pressure-sensitive raw paper and film supports such as polyethylene terephthalate film) at a coverage of 0.3 g of silver per square meter in the case of paper, while 1.5 g of silver per square meter in case of a film. In the case of a paper support, a dispersion, wherein silica was dispersed into 10 wt% ethanol solution of ethylcellulose, was finally coated to produce a polymer layer of a thickness of about 1.5 $\mu$, wherein the silica content was 0.1 of the amount of the ethylcellulose. On the other hand, in the case of a film support, 15 wt% of a tetrahydrofuran solution of vinyl chloride-vinyl acetate copolymer (85:15 monomer weight ratio) was finally coated to produce a polymer layer of a thickness of about 3 $\mu$. The resulting heat developable light-sensitive materials were designated Light-Sensitive Materials (1) and (1′), respectively. (Hereinafter the prime mark designation indicates film support-containing samples similar to the above.)

For the purpose of comparison with the above Light-Sensitive Materials (1) and (1′), heat developable Light-Sensitive Materials (2) and (2′) were prepared in the same manner as the above Light-Sensitive Materials (1) and (1′) except that 25 ml of a 20% acetone solution of 2,2-bis(4-hydroxy-3,5-dimethylphenyl)propane was added as component (c).

These four kinds of heat developable Light-Sensitive Materials (1), (1′), (2) and (2′) were image-exposed to tungsten light through an original having a gradation (exposure amount: $10^4$ lux.second), and then, they were developed by heating at 135° C for 3 seconds. The density of the thermal fog was examined for each of the heat developed samples. In addition, the extent of the whiteness of the background thereof was compared visually. After exposure to diffuse sun light in the vicinity of a window, the image-stability to light was examined. The thermal fog densities of Light-Sensitive Materials (1) and (1') were 0.03 and 0.08, respectively. The background of Light-Sensitive Material (1) was superior to that of Light-Sensitive Material (2) in regard to the whiteness thereof. The background of Light-Sensitive Material (1') had higher transparency than that of Light-Sensitive Material (2'). Moreover, Light-Sensitive Materials (1) and (1') were not essentially changed even under conditions wherein the backgrounds of both Light-Sensitive Materials (2) and (2') become yellow-brown. It is apparent from the above results that the light-sensitive material of the present invention is excellent.

EXAMPLE 2

An aqueous solution of 8.5 g of cetyl ethyl dimethyl ammonium bromide dissolved in 100 ml of water was mixed with 100 ml of toluene to produce an emulsion. An aqueous solution of 0.425 g of silver nitrate in 10 ml of water was added to the emulsion to prepared silver bromide. The resulting silver bromide existed as an emulsion. A solution of 12 g of lauric acid in 100 ml of toluene was mixed with another solution of 1.9 g of sodium hydroxide in 100 ml of water to produce an emulsion. The latter emulsion was added to the former emulsion.

Then, a solution of 8.5 g of silver nitrate in 50 ml of water was added to the above mixed emulsion to result in the formation of silver laurate. Thus, a mixture, wherein silver bromide and silver laurate were in contact with each other, was obtained.

(In the above procedures, solvents comparatively slightly miscible with water can be employed instead of toluene, and silver halides such as silver iodobromide, silver chlorobromide and silver chloroiodobromide can be employed instead of silver bromide. Moreover, other silver salts of fatty acids such as silver myristate and silver palmitate can be employed instead of silver laurate and further, it is well known to the one skilled in this art that other organic silver salts are also applicable.)

The mixture was collected by centrifuging, and then dispersed into 200 g of an ethanol solution containing 30 g of a binder such as polyvinyl butyral using a mixer to prepare a polymer dispersion of the silver salt. (Other alcohols such as methanol, n-propyl alcohol, isopropyl alcohol, etc., can be used instead of ethanol.)

The polymer dispersion of the silver salt was maintained at 30° C, to which the following components were added in their listed order every 5 minutes to prepare a coating solution.

COMPONENT

| | | |
|---|---|---|
| (a) | Dye * (0.025% methanol solution) | 10 ml |
| (b) | Phthalazone (color-toning agent) (3 wt% methanol solution) | 35 ml |
| (c) | Mixed Solution of a 20 wt% Acetone-Solution of 2,2-bis(3-Methyl-4-hydroxyphenyl)propane (auxiliary reducing agent) and a 20 wt% Acetone Solution of the same reducing agent as (c) in Example 1 (mixing ratio by weight: 1 : 9) (reducing agent) (20 wt% solution) | 70 ml |
| (d) | Victoria Blue B**(whitening agent) | 2 ml |

COMPONENT-continued (0.05 wt% methanol solution)

* 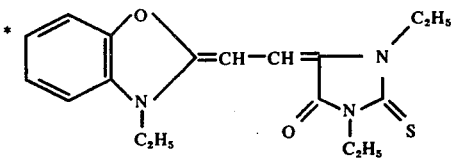

Other merocyanine dyes, cyanine dyes, rhodacyanine dyes, styril system dyes and acidic dyes may be employed.
**Other Blue dyes may be employed similarly.

The sensitizing dye is dispensable where high sensitivity is not required, and phthalazone (or phthalazinone) can be dispensed with where the image may have yellowish brown tone.

The resulting coating solution was coated on a support (e.g., art paper, support paper for a non-carbon paper, etc.) at a coverage of 0.5 g of silver per square meter.

A 10 wt% acetone solution of cellulose diacetate containing 1.5 wt% of kaolin was, then, spread over the above light-sensitive layer as a top coat polymer layer in a thickness of 1.5 $\mu$. (The same amount of silica instead of kaolin can also be used to give the same result as the above.)

The heat developable light-sensitive material obtained by the above procedures was designated Light-Sensitive Material (1).

For the purpose of comparison with the above Light-Sensitive Material (1), heat developable Light-Sensitive Material (2) was prepared in the same manner as heat developable Light-Sensitive Material () except that 70 ml of a 20% acetone solution of 2,2-bis(3-methyl-4-hydroxyphenyl)propane was added as component (c). The light-sensitive materials were exposed and developed by heating under the same conditions as in Example 1. Light-Sensitive Material (1) had more reduced thermal fog and higher light-stability than Light-Sensitive Material (2).

EXAMPLE 3

20 ml of a 2.5 wt% aqueous solution of hydrogen bromide was added to a solution of 8.6 g of capric acid in 100 ml of butyl acetate which was maintained at a temperature of 50° C, while stirring with a stirrer, resulting in the formation of an emulsion. 50 ml of an aqueous of silver nitrate-ammonium complex containing 8.5 g of silver nitrate (which was cooled to a temperature of 5° C) was added dropwise into the resulting emulsion over a 30 second period to allow the capric acid and the hydrogen bromide to react simultaneously with the silver ion. Silver caprate and silver bromide were, then, formed at the same time. (Other silver halide-forming components can be used in a similar reaction to the above.)

After removal of the aqueous phase, the butyl acetate phase containing both the silver caprate and the silver bromide was dispersed into 120 g of a 15 wt% isopropanol solution of polyvinyl butyral to produce a polymer dispersion.

The composition of the several compounds set-forth below was added to the polymer dispersion in their listed order at a temperature of 40° C every 5 minutes. The resulting coating solution was coated on a support (coated paper, resin-coated paper, etc.) at a coverage of 0.7 g of silver per square meter. Then, heat developable Light-Sensitive Material (1) was obtained.

| COMPOSITION | | |
|---|---|---|
| (a) | Lauric Acid (acid stabilizer) (5 wt% methanol solution) | 50 ml |
| (b) | Tetrachlorotetrabromofluorescein (sensitizing dye) (0.025 wt% methanol solution) | 72 ml |
| (c) | Phthalazone (color toning agent) (2.5 wt% methyl Cellosolve solution) | 24 ml |
| (d) | Bisphenol A (reducing agent) (20 wt% methyl Cellosolve solution) | 72 ml |

For the purpose of comparison with heat developable Light-Sensitive Material (1), heat developable Light-Sensitive Material (2) was prepared in the same manner as Light-Sensitive Material (1) except that 50 ml of a 20% acetone solution of octadecyl-3 -(3',5'-di-tert-butyl-4'-hydroxyphenyl)propionate (Compound 18) was added to the above polymer dispersion as component (d).

The light-sensitive materials were processed the same as in Example 1. Light-Sensitive Material (1) was unsuitable for practical use because of the large amount of thermal fog in the background thereof, while Light-Sensitive Material (2) had an extremely high degree of whiteness in the background, and essentially no change caused by exposure to diffuse light in the vicinity of a window could be observed in Light-Sensitive Material (2).

It can be seen from the above results that the light-sensitive material of the present invention was excellent.

EXAMPLE 4

3.4 g of behenic acid was dissolved in 100 ml of benzene at a temperature of 60° C, and the solution was adjusted to a temperature of 60° C). While stirring, 100 ml of water was added to the above solution to produce an emulsion. Aqueous ammonia was added to 80 ml of an aqueous solution containing 1.7 g of silver nitrate to prepare silver-ammonium complex, and then water was further added to make the total volume 100 ml. The resulting silver-ammonium complex-containing solution which was chilled at a temperature of 10° C was added to the above emulsion, resulting in the formation of crystallites of silver behenate. This mixed solution was warmed to ordinary temperature (25° C), and allowed to stand for 20 minutes. The solution separated into an aqueous phase and a benzene phase. After removal of the aqueous phase, the benzene phase was washed with 400 ml of water by decantation. 400 ml of methanol was, then, added to the benzene phase, from which silver behenate was collected by centrifuging. 4 g of spindle-like silver behenate crystals of a longer diameter of about 3 $\mu$ and a shorter diameter of about 1 $\mu$ were obtained.

(Toluene, xylene, pentyl acetate and isoamyl acetate can be effectively used in the place of benzene for preparing silver behenate in a similar manner to the above.)

2.3 g of the resulting silver behenate (about 1/200 mole was dispersed into 20 ml of an ethanol solution containing 2.5 g of polyvinyl butyral by mixing for 1 hour with a ball-mill. (Methanol, propanal and isopropanol can be used effectively instead of the ethanol.)

The composition of the several compounds set-forth below was added to the polymer dispersion in their listed order at a temperature of 50° C every 5 minutes.

| COMPOSITION | | |
|---|---|---|
| (a) | Ammonium bromide (silver halide-forming component) (2.5 wt% methanol solution) | 1 ml |
| (b) | Sensitizing Dye* (0.025 wt% methyl Cellosolve solution) | 1 ml |
| (c) | 2,2'-Methylenebis(6-t-butyl-4-methylphenol) (reducing agent) (25 wt% acetone solution) | 3 ml |
| (d) | Phthalazone (color toning agent) 2.5 wt% methyl Cellosolve solution | 3 ml |

*A merocyanine (2.5 by the following formula

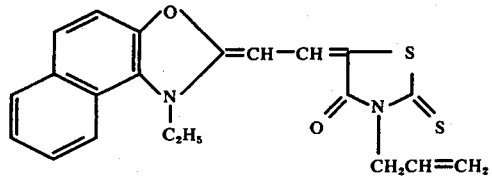

(The same molar amount of an inorganic halide such as hydrogen bromide, sodium bromide, potassium bromide, calcium bromide, and antimony bromide as the above ammonium bromide can be used without decreasing the photographic characteristics.)

(Moreover, merocyanine dyes other than the above-described dye can also be effectively used, wherein the variation in the sensitivity which is achievable by using them is within the range of one fourth to six times. Merocyanine dyes which can be most advantageously used include dyes containing a carboxyl group and nuclei selected from the group consisting of rhodanine, thiohydantoin and 2-thio-2,4-oxazolizinedione nuclei. In the case of using these merocyanine dyes, a sensitivity of about 5 times greater, compared with the above-described dye, can be attained.)

A coating solution prepared using the above procedures was coated on a support (e.g., art paper, coated paper, photographic raw paper and films such as polyethylene terephthalate) at a coverage of 1 g of silver per square meter, resulting in the preparation of heat developable Light-Sensitive Material (1).

For the purpose of comparison, heat developable Light-Sensitive Material (2) was prepared in the same manner as heat developable Light-Sensitive Material (1) except that as component (c) 1 ml of a 25% acetone solution of 2,2'-methylene-bis(6-tert-butyl-4-methylphenol) and 10 ml of a 10% acetone solution of

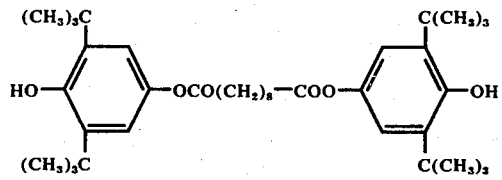

Each of heat developable Light-Sensitive Materials (1) and (2) was image-exposed to tungsten light through an original having a gradation (exposure amount: $10^4$ lux.second), and then, developed by heating at a temperature of 120° C for 20 seconds.

In Light-Sensitive Material (1), the thermal fog density of the background was 0.55. When Light-Sensitive Material (1) was allowed to stand for one day in the vicinity of a window, it was colored yellowish brown by sunlight.

On the other hand, Light-Sensitive Material (2) had a thermal fog density of the background measuring 0.05, and provided a very beautiful copy. The light-stability was tested under the same conditions as Light-Sensitive Material (1). No change caused by exposure to sunlight was observed.

Such an excellent effect as the above is due to the phenol ester with steric hindrance which was used in the combination of the reducing agents.

Instead of tungsten light sources, a mercury lamp, a xenon light source, a CRT light source, a fluorescent lamp light source and a laser beam light source can also be effectively used, if the exposure amount is adjusted to the same amount as provided by the tungsten light.

Almost the same result was obtained under heating conditions at a temperature of 120° C for 20 seconds.

EXAMPLE 5

Light-Sensitive Materials (2) and (3) were prepared the same as Light-Sensitive Material (1) in Example 1 except that as the reducing agent component (c) 2,6-di-t-butyl-4-cresol and 2,4,6-tri-t-butylphenol was employed, respectively, instead of Compound 70. They were exposed and developed in the same manner as in Example 1. The density of the image area was examined for each samples. An image of a pure black tone was obtained in Light-Sensitive Material (1), but both Light-Sensitive Materials (2) and (3) provided purple-tinged gray images. Therefore, beautiful copies could not be obtained with either Light-Sensitive Materials (2) and (3).

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having coated thereon at least one layer containing (a) an organic silver salt, (b) a light-sensitive silver halide or a light-sensitive silver halide-forming component and (c) a reducing agent comprising at least one ester selected from the group consisting of 1. esters of (a) mono- or poly-hydric alcohols or phenols and (b) carboxylic acids derived from phenol derivatives in which at least one of the o-positions thereof is substituted with a substituent selected from the group consisting of an alkyl group having 1 to 20 carbon atoms, a cycloalkyl group having 5 to 7 carbon atoms, and an alkylsulfonyl group having 1 to 20 carbon atoms, and
2. esters of (a) mono- or poly-carboxylic acids and (b) alcohols derived from polyhydric phenols in which at least one of the o-positions thereof is substituted with a substituent selected from the group consisting of an alkyl group having 1 to 20 carbon atoms, a cycloalkyl group having 5 to 7 carbon atoms, and an alkylsulfonyl group having 1 to 20 carbon atoms wherein said reducing agent component (c) is present in an amount ranging from about 0.1 mole to about 10 moles per mole of said organic silver salt component (a).

2. The heat-developable light-sensitive material of claim 1, wherein said substituent in the o-position thereof is a bulky group selected from the group consisting of a branched-chain alkyl group having 3 or more carbon atoms, a straight-chain alkyl group having 12 or more carbon atoms and a cycloalkyl group having 5 to 7 carbon atoms.

3. The heat-developable light-sensitive material of claim 1, wherein said ester of component (c) has the general formula

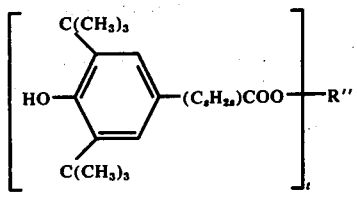

wherein $s$ represents 1, 2, 3 or 4; R'' represents a saturated acylic aliphatic alcohol residue represented by the formula $C_dH_{2d+2-t}$ wherein $d$ represents a positive integer ranging from 1 to 6, and $t$ represents a positive integer ranging from 1 to $4d$.

4. The heat-developable light-sensitive material of claim 1, wherein said light-sensitive silver halide is silver chloride, silver bromide, silver bromoiodide, silver iodobromochloride, silver bromochloride, silver iodochloride, silver iodide or a mixture thereof.

5. The heat-developable light-sensitive material of claim 1, wherein said light-sensitive silver halide-forming component is an inorganic compound represented by the formula $$MX_{n'}$$

wherein M represents a hydrogen atom, an ammonium group, or a metal atom, X' represents a halogen atom, and $n_1$ is 1 when M represents a hydrogen atom or an ammonium group and $n_1$ is the valence of the metal when M represents a metal atom; a halogen containing metallic complex; an onium halide; an N-halo compound containing therein a —CONX'— group or an —$SO_2$NX'— group, wherein X' represents a chlorine atom, a bromine atom, or an iodine atom; an N-halo benzotriazole or substituted benzotriazole; a halogenated hydrocarbon selected from the group consisting of iodoform, bromoform, carbon tetrabromide and 2-bromo-2-methylpropane; and a halogen containing compound selected from the group consisting of triphenylmethyl chloride, triphenylmethylbromide, 2-bromobutyric acid, 2-bromoethanol and dichlorobenzophenone.

6. The heat-developable light-sensitive material of claim 1, wherein said heat-developable light-sensitive material consists essentially of said support and components (a) to (c).

7. The heat developable light-sensitive material of claim 1, wherein said ester of component (c) is an ester having the following general formula (I)

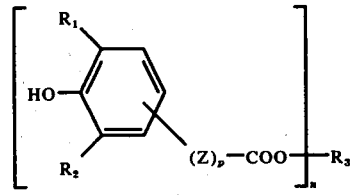

(I)

wherein $R_1$ represents an alkyl group having 1 to 20 carbon atoms or an alkylsulfonyl group having 1 to 20 carbon atoms; $R_2$ represents a hydrogen atom or an alkyl or alkylsulfonyl group as described for $R_1$, which can be the same or different from $R_1$; Z represents a divalent atom or group; $R_3$ represents a mono- or multivalent alcohol or phenol residue; *p* represents 0 or 1; and *n*represents a positive integer equal to the valence of $R_3$.

8. The heat-developable light-sensitive material of claim 7, wherein said ester has the general formula

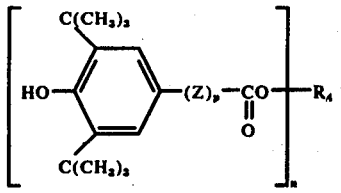

wherein $R_4$ represents a mono- or multi-valent alcohol or phenol residue; *n* represents a positive integer equal to the valence of $R_4$; and Z and *p* are as defined in claim 7.

9. The heat-developable light-sensitive material of claim 7, wherein said alkyl group for $R_1$ is a methyl group, an ethyl group, a propyl group, an isopropyl group, a butyl group, an isobutyl group, a tertiary butyl group, an isoamyl group, a hexyl group, an octyl group, a 2ethylhexyl group, a decyl group, a dodecyl group, a tetradecyl group, a hexadecyl group, or an octadecyl group, and said alkylsulfonyl group for $R_1$ is a methylsulfonyl group, an ethylsulfonyl group, a propylsulfonyl group, a butylsulfonyl group, a pentylsulfonyl group, an isopropylsulfonyl group, a t-butylsulfonyl group, a neopentylsulfonyl group, an octylsulfonyl group, a nonylsulfonyl group, a dodecylsulfonyl group, or an eicosylsulfonyl group.

10. The heat-developable light-sensitive material of claim 9, wherein $R_1$ is a tertiary butyl group, a dodecyl group, a hexadecyl group or an octadecyl group.

11. The heat-developable light-sensitive material of claim 1, wherein said ester of component (c) is an ester having the following general formula (II)

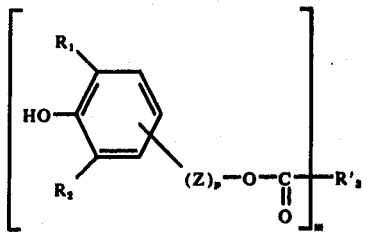

(II)

wherein $R_1$ represents an alkyl group having 1 to 20 carbon atoms or an alkylsulfonyl group having 1 to 20 carbon atoms; $R_2$ represents a hydrogen atom or an alkyl or alkylsulfonyl group as described for $R_1$, which can be same or different from $R_1$; Z represents a divalent atom or group; $R'_3$ represents a mono- or multivalent carboxylic acid residue; *p* represents 0 or 1; and *n* represents a positive integer equal to the valence of $R'_3$.

12. The heat-developable light-sensitive material of claim 11, wherein said ester has the general formula

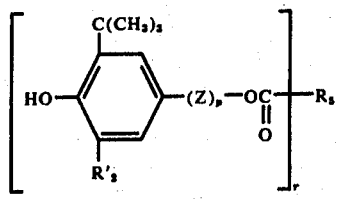

wherein $R'_2$ represents a hydrogen atom or a tertiary butyl group; $R_5$ represents a mono- or multi-valent carboxylic acid residue; *r* represents a positive integer equal to the valence of $R_5$; and Z and *p* are as defined in claim 11.

13. The heat-developable light-sensitive material of claim 11, wherein said alkyl group for $R_1$ represents a methyl group, an ethyl group, a propyl group, an isopropyl group, a butyl group, an isobutyl group, a tertiary butyl group, an isoamyl group, a hexyl group, an octyl group, a 2-ethylhexyl group, a decyl group, a dodecyl group, a tetradecyl group, a hexadecyl group, or an octadecyl group and said alkylsulfonyl group for $R_1$ is a methylsulfonyl group, a pentylsulfonyl group, an isopropylsulfonyl group, a t-butylsulfonyl group, a neopentylsulfonyl group, an octylsulfonyl group, a nonylsulfonyl group, a dodecylsulfonyl group, or an eicosylsulfonyl group.

14. The heat-developable light-sensitive material of claim 13, wherein $R_1$ is a tertiary butyl group, a dodecyl group, a hexadecyl group or an octadecyl group.

15. The heat-developable light-sensitive material of claim 1, wherein said reducing agent component (c) is present in an amount ranging from about ⅓ mole to about 3 moles per mole of said organic silver salt component (a).

16. The heat-developable light-sensitive material of claim 15, wherein the silver coating amount on said support is about 0.2 to 3 g/m² and the amount of component (b) is about 0.001 mole to about 0.5 mole per mole of said organic silver salt (a).

17. The heat-developable light-sensitive material of claim 1, wherein said reducing agent component (c) includes additionally one or more of a substituted phenol, a substituted or unsubstituted mono- or bis-naphthol, a di- or poly-hydroxybenzene, a di- or polyhydroxynaphthalene, a hydroquinone monoether, ascorbic acid or a derivative thereof, a 3-pyrazolidone, a pyrazoline-5-one, a reducing saccharide, a p-phenylenediamine or a derivative thereof, a reductone, kojic acid, hinokitiol, a hydroxy tetron amide, a hydrooxaminic acid, a sulfohydroxy oxaminic acid, a hydrazide, an indane-1,3-dione, a p-oxyphenylglycine, or a mixture thereof.

18. The heat-developable light-sensitive material of claim 17, wherein the amount of said additional reducing agent is about 0.1 mole percent to about 10 mole percent to said ester reducing agent (c).

19. The heat developable light-sensitive material of claim 1, wherein said organic silver salt of component (a) is an imino group-containing organic silver salt, a silver salt of a mercapto group- or thione group-containing compound, a carboxyl group-containing organic silver salt, or a silver salt of a material selected from the group consisting of 4-hydroxy-6-methyl-1,3,3*a*,7-tetraazindene, 5-methyl-7-hydroxy-1,2,3,4,6-pentazaindine, and S-2-aminophenylthiosulfate.

20. The heat-developable light-sensitive material of claim 19, wherein said organic silver salt of component (a) is a silver salt of a carboxyl group-containing compound.

21. The heat-developable light-sensitive material of claim 20, wherein said organic silver salt of component (a) is a silver salt of an aliphatic carboxylic acid.

* * * * *